US010946988B2

(12) United States Patent
Richter et al.

(10) Patent No.: US 10,946,988 B2
(45) Date of Patent: Mar. 16, 2021

(54) METHOD AND DEVICE FOR FORMING PACKAGE BODIES WHICH ARE OPEN ON ONE SIDE USING AN OSCILLATING GRIPPER

(71) Applicant: SIG Technology AG, Neuhausen am Rheinfall (CH)

(72) Inventors: Jürgen Richter, Duesseldorf (DE); Michael Schaaf, Herzogenrath (DE); Christoph Schröder, Waldfeucht-Hontem (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 16/627,892

(22) PCT Filed: Jul. 2, 2018

(86) PCT No.: PCT/EP2018/067746
§ 371 (c)(1),
(2) Date: Dec. 31, 2019

(87) PCT Pub. No.: WO2019/007872
PCT Pub. Date: Jan. 10, 2019

(65) Prior Publication Data

US 2020/0180795 A1 Jun. 11, 2020

(30) Foreign Application Priority Data

Jul. 3, 2017 (DE) ..... 10 2017 114 814.0

(51) Int. Cl.
*B65B 3/02* (2006.01)
*B31B 50/06* (2017.01)
(Continued)

(52) U.S. Cl.
CPC ..... *B65B 3/025* (2013.01); *B31B 50/06* (2017.08); *B31B 50/322* (2017.08);
(Continued)

(58) Field of Classification Search
CPC ..... B31B 5/00; B31B 5/80; B31B 50/782; B31B 50/024; B31B 50/28; B31B 50/32;
(Continued)

(56) References Cited

U.S. PATENT DOCUMENTS 733,449 A * 7/1903 Willsie ..... B65B 1/22 141/75
1,787,077 A * 12/1930 Kruse ..... B65H 3/242 271/102

(Continued)

FOREIGN PATENT DOCUMENTS

CN 1750969 A 3/2006
EP 0356824 A1 3/1990

(Continued)

*Primary Examiner* — Hemant Desai
*Assistant Examiner* — Jacob A Smith
(74) *Attorney, Agent, or Firm* — The Webb Law Firm

(57) ABSTRACT

Described and illustrated is a device for at least partially unfolding package sleeves, having a magazine comprising a stack formed from package sleeves, wherein the package sleeves of the stack are folded flat around at least two folding edges extending in the longitudinal direction of the package sleeves and wherein a gripper is provided for gripping a side of the package sleeves facing away from the stack and for moving, in particular pulling, the package sleeves along a withdrawal transport path with the folding edges into grooves of at least one receptacle of a moulding station and wherein the grooves are spaced so that the folding edges of the package sleeves are spaced apart further in the magazine than in the grooves. In order to further prevent operational malfunctions and allow a more reliable and largely malfunction-free production of packaging bodies which are open on (Continued)

one side from package sleeves which are open on both sides, it is provided that a drive is assigned to the gripper and/or the grooves for moving the package sleeve section gripped by the gripper first along the withdrawal transport path across a groove plane which connects the grooves, then back against the withdrawal transport path across the groove plane, and then again along the withdrawal transport path across the groove plane.

18 Claims, 25 Drawing Sheets

(51) Int. Cl.

| | |
|---|---|
| ***B31B 50/32*** | (2017.01) |
| ***B31B 50/78*** | (2017.01) |
| ***B65B 41/06*** | (2006.01) |
| ***B65B 43/10*** | (2006.01) |
| ***B65B 43/18*** | (2006.01) |
| ***B65B 43/32*** | (2006.01) |
| ***B65B 43/50*** | (2006.01) |
| ***B65B 51/10*** | (2006.01) |
| ***B65B 55/10*** | (2006.01) |
| ***B65B 61/24*** | (2006.01) |
| *B31B 105/00* | (2017.01) |

(52) U.S. Cl.
CPC ..... *B31B 50/784* (2017.08); *B31B 50/788* (2017.08); *B65B 41/06* (2013.01); *B65B 43/10* (2013.01); *B65B 43/185* (2013.01); *B65B 43/325* (2013.01); *B65B 43/50* (2013.01); *B65B 51/10* (2013.01); *B65B 55/10* (2013.01); *B65B 61/24* (2013.01); *B31B 2105/0022* (2017.08)

(58) Field of Classification Search
CPC ..... B31B 50/06; B31B 50/062; B31B 50/322; B31B 50/78; B31B 50/784; B31B 50/788; B31B 2105/0022; B31B 50/802; B65B 3/02; B65B 3/025; B65B 7/16; B65B 41/06; B65B 43/10; B65B 43/185; B65B 43/26; B65B 43/28; B65B 43/30; B65B 43/32; B65B 43/325; B65B 43/50; B65B 51/10; B65B 55/10; B65B 61/24; B65B 43/08; B65B 43/265; B65B 43/285; B65B 2220/02
USPC ..... 53/122, 381.1, 492, 564, 465–458, 565; 493/64, 67, 68, 105, 107, 108, 112, 163, 493/164, 175
See application file for complete search history.

(56) References Cited

U.S. PATENT DOCUMENTS 2,887,021 A * 5/1959 Duffy ..... B31B 50/78 493/313
3,534,667 A * 10/1970 Krause ..... 493/310
3,625,505 A * 12/1971 Lense ..... B65B 65/04 271/14
3,627,308 A * 12/1971 Stoever ..... B65H 3/48 271/104
3,676,977 A * 7/1972 Rothmann ..... B65B 43/32 53/437
3,750,931 A * 8/1973 Dick ..... B65D 5/0227 229/132
3,896,711 A * 7/1975 Vuilleumier ..... B31B 50/00 493/314
4,213,285 A * 7/1980 Mancini ..... B65B 43/285 156/522
4,414,789 A * 11/1983 Pattarozzi ..... B65B 43/185 53/566
4,439,174 A * 3/1984 Derderian ..... B31B 50/00 493/125
4,456,118 A * 6/1984 Kauffman ..... B65B 3/025 198/462.1
4,473,989 A * 10/1984 Tsutsumi ..... B65B 43/30 141/166
4,530,692 A * 7/1985 Williams ..... B31B 50/78 493/309
4,583,965 A * 4/1986 Argazzi ..... B65B 43/265 493/313
4,921,237 A * 5/1990 Nubson ..... B65H 1/02 271/104
5,033,975 A * 7/1991 Traegaardh ..... B65B 43/325 493/310
5,058,364 A * 10/1991 Seiden ..... B65B 43/123 53/455
5,061,231 A * 10/1991 Dietrich ..... B65B 43/185 271/95
5,176,608 A * 1/1993 Wakabayashi ..... B65B 43/185 493/125
5,180,356 A * 1/1993 Wakabayashi ..... B65B 41/06 493/316
5,382,217 A * 1/1995 Namowitz ..... B31B 50/00 493/310
5,454,215 A * 10/1995 Martelli ..... B65B 43/325 198/475.1
5,531,661 A * 7/1996 Moncrief ..... B65B 43/265 493/313
5,778,639 A * 7/1998 Sireix ..... B31B 50/00 53/289
5,826,870 A * 10/1998 Vulgamore ..... B65B 43/185 271/1
5,842,328 A * 12/1998 Kinoshita ..... B31B 50/00 53/565
5,867,966 A * 2/1999 Mogard ..... B65D 5/746 493/105
5,941,681 A * 8/1999 Piotrowski ..... B65H 1/06 271/106
5,980,440 A * 11/1999 Mitman ..... B31B 50/00 493/128
6,383,123 B1 * 5/2002 Ehring ..... B65B 43/265 493/315
6,682,065 B2 * 1/2004 Leonarde ..... B65B 41/06 271/104
6,699,165 B1 * 3/2004 Krieger ..... B65B 43/325 493/122
6,793,213 B2 * 9/2004 Ito ..... A63H 17/262 221/211
7,025,259 B2 * 4/2006 Mausy ..... B65H 3/085 235/379
7,243,481 B2 * 7/2007 Draghetti ..... B65B 5/024 493/313
7,584,593 B2 * 9/2009 Murray ..... B65B 43/30 493/309
7,644,916 B2 * 1/2010 Spatafora ..... B65H 3/34 271/101
7,669,385 B2 * 3/2010 Sichera ..... B65B 25/002 53/53
7,819,791 B1 * 10/2010 Ross ..... B65D 5/4204 493/319
8,468,783 B2 * 6/2013 Uebler ..... B65B 43/28 53/457
8,951,177 B2 * 2/2015 Ford ..... B65B 43/325 493/70
9,126,380 B2 * 9/2015 Dittmer ..... B31B 50/00
9,180,986 B2 * 11/2015 Takahashi ..... B65B 43/465
9,486,972 B2 * 11/2016 Mack ..... B65D 5/12
9,505,512 B2 * 11/2016 Havens ..... B65B 43/26
9,533,785 B2 * 1/2017 Rapp ..... B65B 59/003
2004/0000121 A1 * 1/2004 Ichikawa ..... B65B 5/105 53/173
2004/0025476 A1 * 2/2004 Oliverio ..... B65B 43/267 53/450
2006/0073957 A1 4/2006 Martelli

(56) References Cited

U.S. PATENT DOCUMENTS

| | | | | |
|---|---|---|---|---|
| 2007/0072757 | A1* | 3/2007 | Goodman | 493/313 |
| 2007/0180794 | A1* | 8/2007 | Paunesku | B65B 9/087 53/455 |
| 2011/0177929 | A1 | 7/2011 | Ford | |
| 2012/0240528 | A1* | 9/2012 | McCracken | B31B 50/00 53/492 |
| 2014/0126986 | A1* | 5/2014 | Corallo | B65B 43/44 414/737 |
| 2014/0260119 | A1* | 9/2014 | Baltes | B65B 43/126 53/492 |
| 2015/0031519 | A1* | 1/2015 | Cavazza | B65B 59/005 493/441 |
| 2015/0068163 | A1* | 3/2015 | Baltes | B65B 43/24 53/492 |
| 2016/0376045 | A1* | 12/2016 | Seiche | B65B 5/065 53/426 |
| 2017/0001740 | A1* | 1/2017 | Richard | B65H 29/32 |
| 2017/0152067 | A1* | 6/2017 | Nakamoto | B65B 43/26 |

FOREIGN PATENT DOCUMENTS

| | | | |
|---|---|---|---|
| EP | 2090512 | A2 | 8/2009 |
| EP | 2345590 | A1 | 7/2011 |
| JP | H1213121 | A | 8/1989 |
| JP | 2002255117 | A | 9/2002 |
| WO | 2013053646 | A1 | 4/2013 |

* cited by examiner

METHOD AND DEVICE FOR FORMING PACKAGE BODIES WHICH ARE OPEN ON ONE SIDE USING AN OSCILLATING GRIPPER

CROSS-REFERENCE TO RELATED APPLICATION

This application is the United States national phase of International Application No. PCT/EP2018/067746 filed Jul. 2, 2018, and claims priority to German Patent Application No. 10 2017 114 814.0 filed Jul. 3, 2017, the disclosures of which are hereby incorporated by reference in their entirety.

BACKGROUND OF THE INVENTION

Field of the Invention

The invention relates to a method for at least partially unfolding package sleeves, in particular in order to form package bodies which are open on one side from package sleeves which are open on both sides for the production of filled packages. The invention also relates to a device for at least partially unfolding package sleeves, in particular for forming package bodies which are open on one side from package sleeves which are open on both sides for the production of filled packages, having a magazine comprising a stack formed from package sleeves, wherein the package sleeves of the stack are folded flat around at least two folding edges extending in the longitudinal direction of the package sleeves and wherein a gripper is provided for gripping a side of the package sleeves facing away from the stack and for moving, in particular pulling, the package sleeves along a withdrawal transport path with the folding edges into grooves of at least one receptacle of a moulding station and wherein the grooves are spaced so that the folding edges of the package sleeves are spaced apart further in the magazine than in the grooves.

Description of Related Art

Methods and devices for forming package bodies which are open on one side from package sleeves which are open on both sides have been known for quite some time. The methods are used in particular to manufacture filled packages, with methods and devices for filling packages with products in different embodiments also being known.

In this context, package bodies are understood to mean containers such as, for example, cardboard composite packages, which are at least partially formed from a packaging material laminate in the form of a laminate comprising a cardboard layer and outer, in particular thermoplastic, plastic layers, for example made of polyethylene (PE). The cardboard confers sufficient stability on the packages, so that the packages can be easily handled and for example stacked. The plastic layers protect the cardboard from moisture and the foodstuffs from the absorption of undesired substances from the package. In addition, further layers can be provided, such as an aluminium layer, which prevents a diffusion of oxygen and other gases through the packaging material laminate.

Corresponding package bodies are typically filled with products in the form of foodstuffs, in particular beverages, with the products being predominantly flowable products. In particular, the package bodies are filled with foodstuffs in a sterile or aseptic environment of a filling machine, since the foodstuffs must be durable for a long time after the packages have been filled. To this end, the filling machines comprise, for example, sterilisation spaces or aseptic chambers, in which the package bodies are sterilised and subsequently filled and closed under the most sterile conditions possible. After the package bodies have been filled, they are typically closed in the filling machine. If corresponding packaging material laminates are used, the package body is closed by sealing the open end.

The package bodies are preferably formed on the filling machine from package sleeves, which in turn are made from package laminate blanks, in particular by sealing the longitudinal edges of the package laminate blanks onto one another. The inner longitudinal edge can be folded outwards to prevent moisture from penetrating into the packaging material laminate, in particular the cardboard. In this way, package sleeves formed from a packaging material laminate are produced which are open at the opposite longitudinal ends. The package sleeves are pre-folded along four fold lines extending longitudinally relative to the package sleeve, thereby creating folding edges which form the later edges of the package, which typically forms a square or rectangular cross-section. First, however, the package sleeves are folded flat around two opposite folding edges. Two of the pre-folded fold lines are folded back again in doing so. The package sleeve then substantially forms two sections extending parallel to each other and lying on top of each other.

The flat-folded package sleeves are transferred as stacks to a magazine of the filling machine. The front section of the package sleeve at the front end of the stack, i.e. the front side of the flat-folded package sleeve, is gripped by suction cups and pulled away from the stack, in doing so the package sleeve unfolds, typically until an at least substantially square or rectangular cross-section is formed. Both the front side and the rear side of the flat-folded package sleeve each form two of the four sides of the unfolded package sleeve. The unfolding also takes place along the pre-folded fold lines, two of which have formed the folding edges of the folded package sleeve, as the packaging material laminate can be easily kinked or folded along the, in particular pre-folded, fold lines. The correspondingly unfolded package sleeve is then pulled onto a mandrel of a so-called mandrel wheel, the cross-section of the mandrel corresponding to the cross-section of the package sleeve. The package sleeve initially protrudes outwards beyond the mandrel, so that the protruding part of the package sleeve can be folded against the end face of the mandrel, where it can be pressed and sealed. The corresponding longitudinal end of the package sleeve is thus closed and regularly forms the base of the later filled package. Alternatively, the closed end of the package sleeve could, however, also form the head of the later package if, for example, the latter is filled through the open base.

The package bodies which are open on one side are channelled into a sterilisation zone of the filling machine. This takes place in most cases by the package bodies being transferred successively to the cells of the transport device receiving the package bodies. The transport device then ensures that the package bodies are transported with a defined speed at a defined distance to each other through the sterilisation zone of the filling machine. In the sterilization zone, the package bodies are preheated with hot sterile air and then sterilised, typically with hydrogen peroxide, and dried with sterile air. The sterile package bodies are transferred into the filling and sealing zone and filled there. The opening of the filled package bodies is subsequently closed before the closed package is transported via the transport device out of the filling and sealing zone and is subsequently removed from the corresponding cells of the transport device.

In some filling machines, the package bodies are transported by the transport device in a straight line through the filling machine. Corresponding filling machines are also referred to as inline systems. In other filling devices, the so-called rotary systems, the package bodies detail a more or less arc-shaped movement, which can comprise one or a plurality of arc sections. The present invention generally concerns both types of filling machines.

A method and a device for operating a moulding station for unfolding package sleeves removed from a magazine and folded flat in order to push said package sleeves onto a mandrel of a mandrel wheel is described in WO 2013/053646 A1, for example. In practice, operational malfunctions occur again and again in these and other moulding stations. The package sleeves regularly fail to unfold as intended by the method or device.

Therefore, the object of the present invention is to design and further develop the method and the device of the type mentioned at the outset and explained in more detail above in such a way that operational malfunctions are further avoided and a more reliable and largely malfunction-free production of package bodies which are open on one side from package sleeves which are open on both sides is made possible.

SUMMARY OF THE INVENTION

Accordingly, this object is achieved by a method for at least partially unfolding package sleeves, in particular for forming package bodies which are open on one side from package sleeves which are open on both sides for the production of filled packages, the flat-folded package sleeves are provided, the package sleeves, which are folded flat around at least two folding edges extending in the longitudinal direction of the package sleeves, are held ready in a stack for further processing, the flat-folded package sleeves are successively gripped on a side facing away from the stack by a gripper and moved, in particular pulled, by the gripper along a withdrawal transport path of the package sleeves with the folding edges into grooves of at least one receptacle of a moulding station, thereby at least partially unfolding the package sleeves, in which the package sleeves received with the folding edges in the grooves of the at least one receptacle are moved, in particular pressed, by the gripper at least in sections against the withdrawal transport path and/or are moved, in particular pressed, with the grooves further in the direction of the withdrawal transport path relative to the gripper and In which the package sleeves moved back at least in sections against the withdrawal transport path and received with the folding edges in the grooves are moved, in particular pulled, by the gripper again at least in sections in the direction of the withdrawal transport path and/or the package sleeves moved further in the direction of the withdrawal transport path relative to the gripper and received with the folding edges in the grooves are moved back, in particular pulled, with the grooves against the direction of the withdrawal transport path relative to the gripper.

Said object is further achieved in a device, having a drive is assigned to a gripper and/or grooves for moving a section of a package sleeve gripped by the gripper first along a withdrawal transport path across a groove plane which connects the grooves, then back over the groove plane against the withdrawal transport path, and then again along the withdrawal transport path across the groove plane.

The basic principle for unfolding package sleeves is that the package sleeves are first pulled into at least one receptacle, thereby the folding edges of the package sleeves engage in grooves which are arranged at such a distance from one another that the package sleeves are slightly compressed through being received in the grooves. The purpose of compressing the package sleeves via their folding edges is to ensure that the package sleeves unfold at least slightly. In addition, the compression of the package sleeves will when required be even more distinct before they are received in the grooves, since the grooves are preferably designed as undercuts in the transport direction. The package sleeves, which are initially folded flat, are thus moved by the gripper, which only acts on one side of the pack sleeve, against a corresponding resistance. While one side of the flat-folded package sleeve is moved, in particular pulled, by the gripper into the bottleneck, this side of the package sleeve bends in the transport direction of the package sleeve. The opposite side of the flat-folded package sleeve will not normally bend in the same direction, as no gripper acts on this side. However, this rear side of the package sleeve is pulled via the connecting borders with the front side of the flat-folded package sleeve, from the front side of the package sleeve, on which the gripper acts, into the bottleneck between the grooves, which is why this rear side of the package sleeve is also compressed. This compression normally results in the rear side of the package sleeve bending against the transport direction of the package laminate. Since the front side of the package sleeve is typically bent in the transport direction, this results in the package sleeve, which is held in the grooves, unfolding at least slightly.

In the event that the flat-folded package sleeves, in addition to the folding edges around which the package sleeves are folded flat in the magazine, have further fold lines along which the package sleeves are weakened so that the package sleeves can be easily and reliably folded around the fold lines, the front side and/or rear side of the flat-folded package sleeve may kink around at least one fold line instead of being bent as a whole. However, the direction of the bends and the direction of the kinks is generally the same and preferably as described above. The only difference is that the forces acting bend a surface or, if surface has a weakening in the form of a fold line, fold the adjacent surface sections around the fold line.

The fold lines can be provided in different ways. It is, for example, possible to pre-fold the package laminate on the fold lines. It is alternatively or additionally also possible to introduce a crease for forming the fold line in the package laminate. The package laminate is in this case compressed line by line by a creasing tool, e.g. a narrow wheel, and thus weakened along the corresponding line, i.e. the fold line. Further methods known per se for introducing fold lines into package laminates are conceivable.

In some cases, the front sides and rear sides of the initially flat-folded package sleeves do not bend or fold as described above in different directions. Rather, it may happen that not only the front side of a package sleeve, but also its rear side is bent or folded in the transport direction, while the package sleeve is received with the folding edges in the grooves of the at least one receptacle. In other words, with the exception of the folding edges received in the grooves, the front side and the rear side are arranged in the transport direction behind the groove plane extending through the grooves.

As a result, no slight unfolding of the package sleeves for further processing the same is achieved, in any case not in the desired manner, in which the rear side of the package sleeve, viewed in the transport direction of the package sleeve, is arranged in front of the groove plane. The further processing therefore cannot be carried out as planned and an operational malfunction may occur which may necessitate plant downtime or, in any case, undesired intervention.

With package sleeves which, in addition to the two folding edges for folding the package sleeves flat, have at least one fold line on the rear side of the flat-folded package sleeve, it is generally possible to work in a more failure-free manner because the fold line ensures that the rear side is kinked more easily in the correct direction, i.e. against the transport direction of the package sleeve. Even in such cases, however, malfunctions cannot be ruled out, as practical experience shows.

The invention has now recognised that the at least partial unfolding of the packages can be reliably achieved if the gripper is not moved in the transport direction along the withdrawal transport path to an end position, where it is separated from the package sleeve. Rather, the gripper is moved back once again in order to bend or kink the rear side of the package sleeve backwards in the direction of the stack. For this purpose, the gripper is moved back against the actual transport direction so far that the front side of the package sleeve, in the transport direction of the package sleeve, is no longer arranged behind but rather in front of the groove plane defined by the grooves receiving the folding edges. This ensures that the rear side is bent or folded as a result against the transport direction.

The gripper is then adjusted again in the actual transport direction and preferably moved into an end position, which may be but does not have to be the end position reached before the moving back, and in fact before the gripper releases the respective package sleeve. This ensures that the front side of the package sleeve is bent or kinked forwards as desired in the transport plane relative to the groove plane. Together with the rear side of the package sleeve bent or kinked backwards relative to the groove plane, a package sleeve is obtained which is held in the grooves and at least partially unfolded. After the gripper has unclasped or released the package sleeve, the gripper is moved back to the stack of package sleeves in order to grip a further package sleeve there and to position it in the same manner, with a short movement back and forth, in an at least partially unfolded fashion in the grooves of the at least one receptacle.

In other words, the package sleeves received with the folding edges in the grooves of the at least one receptacle are moved back, in particular pressed, at least in sections by the gripper against transport direction along the withdrawal transport path. This moving back or pressing back preferably also applies to the rear side of the flat-folded package sleeve. Subsequently, at least the section of the package sleeve gripped by the gripper, in particular the section of the front side of the initially flat-folded package sleeve gripped by the gripper, is again moved, in particular pulled, by the gripper in the direction of the withdrawal transport path. However, the package sleeves continue to be received in the grooves with the folding edges which, here, separate or connect the rear side of the package laminate and the front side of the package laminate. The gripper preferably unclasps the front side of the package sleeve only when the rear side of the package sleeve, viewed in the transport direction of the package sleeves, is bent or kinked backwards and at the same time the front side is bent or kinked in the transport direction.

If necessary, however, instead of the gripper, the groove holding the package sleeve can also be moved back and forth to achieve a reliable partial unfolding of the package sleeve. In this case, for the sake of simplicity, the gripper can remain in one position. However, this does not have to be the case. In any case, the grooves are moved relative to the gripper. In order to achieve the same relative movements between the gripper and the groove as described above, the grooves are initially moved and/or pressed further in the direction of the transport direction relative to the gripper or in the direction of the withdrawal transport path. The front side and rear side of the package sleeve can thus be bent or kinked against the direction of the withdrawal transport path. Subsequently, the counter-movement occurs, in which the grooves holding the package sleeve are moved back again relative to the gripper, against the direction of the withdrawal transport path. Since the gripper continues to hold the front side of the package sleeve, the front side remains in the position already assumed, bent and/or kinked in the direction of the withdrawal transport path. However, the rear side is bent and/or kinked by moving the grooves back in the opposite direction so that reliable, at least partial, unfolding of the package sleeve is achieved.

In terms of the device, it is accordingly provided that a drive is assigned to the gripper and/or the grooves for moving the section of the package sleeve gripped by the gripper, that is, with respect to the flat-folded state of the package sleeves in the stack of the magazine the front side of the package sleeve, first along the withdrawal transport path across a groove plane connecting the grooves. This can preferably be achieved by moving the gripper to pull the package sleeve off the stack. The package sleeve is then moved back by a movement of the gripper and/or of the grooves receiving the package sleeve, said movement being driven by the drive, over the groove plane against the withdrawal transport path. This ensures that the rear side of the package sleeve is bent or kinked, relative to the groove plane, back to the stack or against the transport direction. The gripper can now be moved forwards again in the transport direction and/or the grooves can now be moved back again against the transport direction, as the rear side of the package sleeve will reliably retain its shape from now on. The front side of the package sleeve is thus moved, in particular pulled, again along the withdrawal transport path in the transport direction across the groove plane, so that the front side of the package sleeve is reliably bent or kinked in the transport direction. Now the gripper can detach itself from the package sleeve, since the package sleeve is held as desired with the folding edges in the grooves of the at least one receptacle and is at least partially unfolded.

Below, for the sake of greater clarity and to avoid unnecessary repetitions, the method and the device are described together. To a person skilled in the art, however, it is clear which features are particularly preferred for the method and the device.

In a first particularly preferred embodiment of the method, the package sleeves are received at least partially in the grooves bent and/or kinked in a direction defined by the withdrawal transport path. The package sleeves are therefore received in the grooves as required and at the same time bent and/or kinked at least partially in the transport direction beyond the groove plane extending between the grooves. In this case, the transport direction is defined by the withdrawal transport path. The correspondingly bent and/or kinked part of the package sleeve is preferably the section of the package sleeve gripped by the gripper and/or the front side of the package sleeve with respect to the state of the package sleeve when folded flat and received in the magazine. Subsequently, the package sleeves continue to be held in the grooves during partial movement back against the transport direction along the withdrawal transport path, in which case, however, the package sleeve is bent and/or kinked at least in sections against the transport direction defined by the withdrawal transport path.

The correspondingly bent and/or kinked section is in this case preferably a section which is not gripped by the gripper and/or the rear side of the package sleeve in the flat-folded state. The corresponding section preferably remains in this position, while another section of the package sleeve, in particular the section of the package sleeve gripped by the gripper, is, preferably again, bent and/or kinked in the opposite direction by adjusting the gripper again in the transport direction along the transport path and/or the grooves against the transport direction along the transport path. In addition, the fold lines remain in the grooves. In other words, the section of the package sleeve gripped by the gripper can first be bent in the transport direction, then against the transport direction and finally back in the transport direction. Bending back the package sleeve in phases ensures that a rear section of the package sleeve, viewed in the transport direction, remains in a position in which it is bent against the transport direction, while the other section gripped by the gripper is bent and/or kinked for the last time in the transport direction, so that a package sleeve is provided which is partially unfolded in a defined manner and is held in the grooves of the at least one receptacle. The corresponding bending and/or kinking of the package sleeve may be caused by a movement of the gripper and/or the grooves.

Whether the sections bend or kink as a result of the movement of the gripper and/or the grooves as described above depends in particular on the type of package sleeve. In the event that the package sleeves have fold lines on corresponding sections of the package sleeves, kinking the sections is possible because they can be easily folded along the fold lines. Depending on how easy it is to fold the corresponding sections of the package sleeves, the sections can also be bent in addition to being kinked. In contrast, in the absence of additional fold lines, the relevant sections of the package sleeve may in particular, but not necessarily, be only bent.

To be able to take the package sleeves easily and reliably from the stack and release them again after they have been transferred into the grooves of the at least one receptacle, it is appropriate to grip the sides of the package sleeves facing away from the stack, in particular the front sides, successively with suction cups of the gripper and to pull them from the stack. A vacuum can be created at the suction cups by extracting air, so that the package sleeves are securely held on the suction cups.

In order to achieve rapid and simple conveying of the package sleeves and thus a high overall throughput of package sleeves, it is expedient to move or pull the package sleeves from the stack and into the grooves along a straight withdrawal transport path. For the sake of further simplification and to protect the package sleeves, the withdrawal transport path can further be aligned parallel to the stacking direction of the packages in the stack.

In principle, it can be provided that the package sleeves are not yet completely and/or not definitively unfolded due to the transfer from the stack into the grooves of the at least one receptacle. This is also more gentle on the package sleeves, so that damage to the package sleeves can be avoided. In this case, the package sleeves can be subsequently unfolded in the moulding station for transfer into the grooves or in any case further unfolded. This can be carried out simply and reliably because the package sleeves have previously been brought into a defined and suitable starting position for further handling or processing.

The at least further unfolding of the package sleeves transferred to the grooves can be carried out as required between at least two mould halves of a mould, between which the package sleeves are positioned beforehand. For unfolding, the mould closes at least partially by moving the at least two mould halves at least partially towards each other. In principle, it would also be possible for only one mould half to be moved and for the other mould half to remain in its position, but even then, in relative terms, the two mould halves would still be moved towards each other with respect to the package sleeve. This is obvious to a person skilled in the art and does not require any detailed, separate description. This complete or at least partial closing of the mould finally causes the package sleeves to unfold. It may be expedient for a defined shaping and a defined subsequent transfer of the unfolded package sleeves if the package sleeves are unfolded by at least substantially circumferentially coming into contact of the respective package sleeves to the inside of the mould. Thus, it is also possible to give the package sleeves a shape which is defined by the inner surface of the mould and would not be obtained without applying the package sleeves to the inside of the mould.

Alternatively or additionally, the unfolding can be simplified if from opposite sides of the package sleeve it is pressed against the at least two folding edges such that the at least two folding edges of the package sleeve move towards one another while unfolding the package sleeve. Depending on the embodiment of the package sleeves, for example with supplementary fold lines, it may even be possible to dispense with a mould, in any case a closed mould. In this regard, the fact that the package sleeves are held in the grooves of the at least one receptacle after the gripper has transferred the package sleeves to the grooves can be also be utilised. Thus, in a simple and reliable embodiment of the method and the device, via the grooves of the at least one receptacle it can be pressed against the at least two folding edges of the package sleeve from opposite sides of the package sleeve so as to move the folding edges towards one another and thereby unfold the package sleeve.

A tapered channel can be used to connect the transfer of the package sleeves from the stack to the grooves with an unfolding of the package sleeves, which is in any case not insignificant, so that, as required, said package sleeves then only have to be unfolded slightly or no longer have to be unfolded at all. This tapered channel is provided in the transport direction between the stack and the grooves of the at least one receptacle, so that the package sleeves are moved or pulled through the channel before being received in the grooves and are thereby forcibly unfolded at least in parts. This is carried out while the package sleeves, with the two opposite folding edges, come into contact with the inside of the channel, transversely to the package sleeve and transversely to the transport direction of the package sleeves through the tapered channel. The tapering of the channel causes the folding edges to move steadily towards each other as they slide along the channel and, as a result, to continue to unfold depending on the tapering of the channel. In this case, moving parts and the control thereof can be at least substantially dispensed with. For the sake of simplicity, it may in principle be preferred if the channel is part of the magazine or directly connected to the magazine. The magazine and the channel can thus form one unit and the inner sides of the channel can be connected directly to the end of the magazine as viewed in the transport direction.

For the sake of simplicity and reliability, it is also appropriate if the unfolded package sleeves are pushed from the moulding station onto a mandrel of a mandrel wheel to close, in particular seal, a longitudinal end of the package sleeve.

Alternatively or additionally, use can be made of the fact that the package sleeves are transferred from the stack into the grooves when the package sleeves are transported further in the longitudinal direction of the grooves, whether for unfolding into a mould or pushing directly onto a mandrel. The latter can be considered in particular if the package sleeves are already sufficiently unfolded before being received in the grooves or if further unfolding takes place while the package sleeves are held in the grooves. Furthermore, the package sleeves can be transported further in the grooves and/or with the grooves. This depends, on the one hand, on the method costs or equipment costs to be incurred and, on the other hand, on the need to protect the folding edges of the package sleeves against abrasion or damage.

In a first particularly preferred embodiment of the device, the gripper is equipped with suction cups for gripping the package sleeves held in the magazine. The package sleeves can thus be gripped and released again simply and in a defined manner, which is particularly the case if the suction cups are assigned an extraction device for extracting air from the suction cups.

Alternatively or additionally, the drive can be designed to move the gripper between the magazine and the grooves along a straight transport withdrawal path. This straight movement of the gripper is also simple to realise in the case of fast oscillating movements of the gripper. This is particularly expedient in terms of equipment if the withdrawal transport path of the gripper is aligned parallel to the stacking direction of the packages in the stack.

The moulding station can have at least two mould halves which can form a mould for the package sleeves, so that the package sleeves transferred from the gripper to the grooves can subsequently be further unfolded simply and reliably. The mould halves press the package sleeves together and unfold the package sleeves at the same time. It may be expedient for the reliable and defined shaping of the unfolded package sleeves if the mould halves and the package sleeves complement each other in such a way that the package sleeves come into contact with the mould halves or the inside of the mould at least substantially circumferentially. Preferably, the inside of the mould is then shaped in the same way as the unfolded package sleeves should be shaped In principle, the mould can be completely or at least partially closed by the mould halves.

In this case, the grooves can be designed as parts of the mould halves or additional mould halves are dispensed with. The grooves can be utilised as required to push the folding edges together and thereby unfold the package sleeves since the grooves of the at least one receptacle are adjustable from a receiving position for receiving the package sleeves at a large distance from one another into an unfolding position for unfolding the package sleeves at a smaller distance from one another and back. The package sleeves are then received in the grooves, while the latter are spaced further apart in the receiving position. The grooves are then moved towards each other until the unfolding position is reached and the received package sleeve is unfolded.

The unfolding of the package sleeves may alternatively or additionally take place at least partially before the package sleeves are received in the grooves of the at least one receptacle, in a manner which is simple in terms of equipment but nevertheless reliable. For this purpose, the moulding station has a tapered channel through which the package sleeves must pass on their way to the grooves. The folding edges of the package sleeves can slide along the inner sides of the tapered channel and are moved towards each other as a result of the tapering, leading to at least partial and forced unfolding of the package sleeves as they pass through the channel. This becomes even more reliable if the package sleeves are moved in a straight line through the channel in the direction of the grooves. It also appropriate if the width of the channel tapers in the transport direction of the package sleeves along the withdrawal transport path to a dimension which is smaller than the width of the flat-folded package sleeves received in the magazine. Nevertheless, it can be expedient for a material-friendly entry into the channel if it the latter is initially wider than the width of the flat-folded package sleeves received in the magazine. For a material-friendly passage through the channel, it may alternatively or additionally be appropriate for the channel to taper continuously.

For the transfer and handling of the package sleeves, which are forced to be at least partially unfolded in the channel, it is appropriate if the grooves for receiving the folding edges are assigned to the end of the channel, in particular if they are arranged at the end of the channel. The package sleeves are then forced with the folding edges into the grooves. In addition, the channel and the grooves can be designed to form an undercut and to partially compress the package sleeves in their transverse direction. As a result, the package sleeves are held reliably and simply in the grooves as required.

Irrespective of this, a mandrel may be provided onto which the unfolded package sleeves are pushed and, preferably, for closing, in particular for sealing, a longitudinal end of the package sleeve in the state in which said package sleeve is pulled onto the mandrel. This leads to a defined and reliable shaping and formation of a partially closed pack as required and can also be easily and reliably combined with the at least partial unfolding of the package sleeves in the grooves.

For the further transport of the package sleeves received in the grooves, displacement means can be provided which can serve the displacement of the package sleeves in the longitudinal direction of the grooves. In this case, the displacement of the package sleeves can be carried out in a defined and precise manner in the grooves in which the package sleeves are received. In addition, to avoid unnecessary friction, the package sleeves can be displaced with the grooves in which the package sleeves are received. Independently of the type of displacement, for the sake of simplicity, the package sleeves are displaced into a mould and/or onto a mandrel by means of the displacement described.

BRIEF DESCRIPTION OF THE DRAWINGS

The inventions disclosed here are explained in greater detail below with reference to a drawing merely depicting an exemplary embodiment, wherein.

DESCRIPTION OF THE INVENTION

Figure 1A:
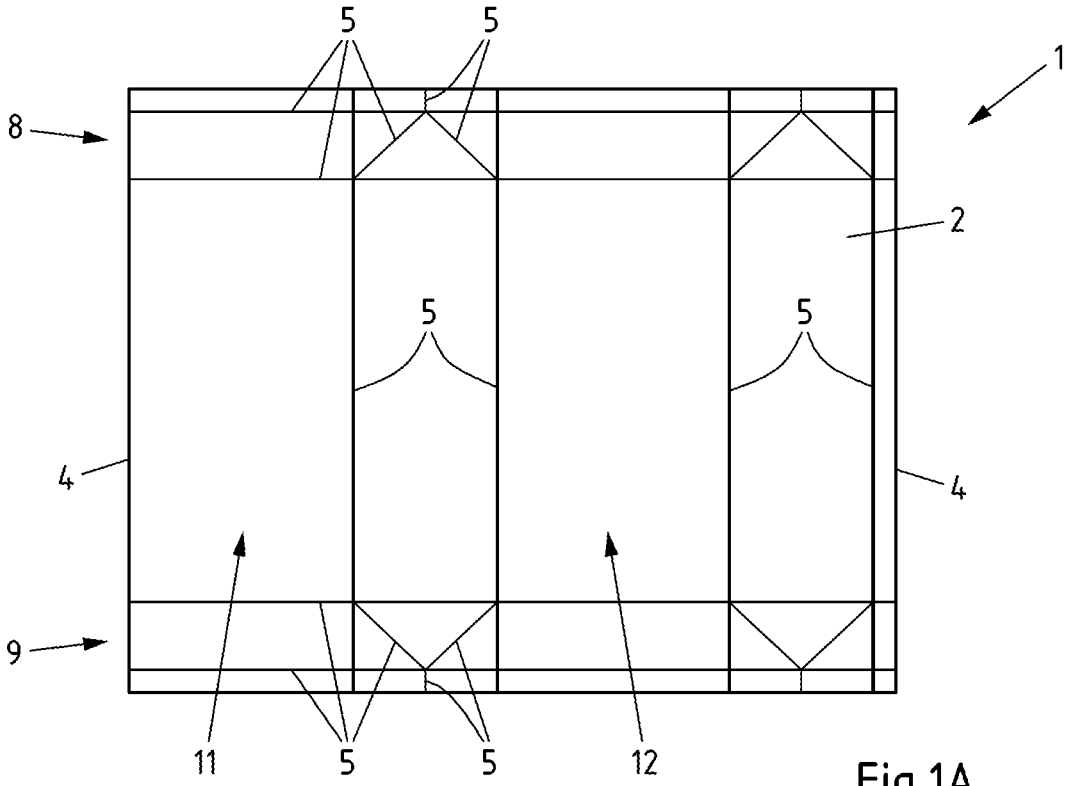
Fig.1A Prior Art
FIGS. 1A-B show a blank of a packaging material laminate and a package sleeve of the prior art formed from the blank, in each case in plan view.

FIG. 1A describes a blank 1 of a packaging material laminate 2 as known from the prior art. The packaging material laminate 2 is designed as a laminate consisting of several layers of material arranged one above the other. In particular, it is a cardboard/plastic composite. The shown packaging material laminate 2 has two outer layers made of a thermoplastic plastic, preferably polyethylene (PE), which enable outer layers of the packaging material laminate 2 to be sealed, i.e. heat-sealed. Between them, a structuring cardboard layer with a comparatively high bending stiffness for the packaging material laminate 2 is provided. In addition, at least one barrier layer can also be provided which is preferably formed from aluminium, polyamide and/or an ethylene vinyl alcohol. Further layers are also conceivable.

The blank 1 is used to produce a package sleeve 3, which is formed by the fact that the outer and opposite longitudinal borders 4 of the blank 1 are bent over towards each other and joined to each other, in particular sealed onto each other. The blank 1 has a row of fold lines 5 on which the blank 1 can be folded to form the desired package 7. The fold lines 5, which are creasing lines if required, simplify the folding and also ensure reliable folding. Most fold lines 5 are provided on the top border 8 and the bottom border 9 of the blank 1, which are later folded to form the base and the head or the gable of the package 7. In addition, the blank 1 has four substantially parallel fold lines 5 on which the blank 1 is pre-folded before or after the package sleeve 3 is formed. If the packaging material laminate 2 has been bent over once on the fold lines 5, there is only a slight resistance to further folding of the packaging material laminate 2 at the same point, which is in any case significantly lower than along fold lines 5 which have not yet been folded.

Figure 1B:
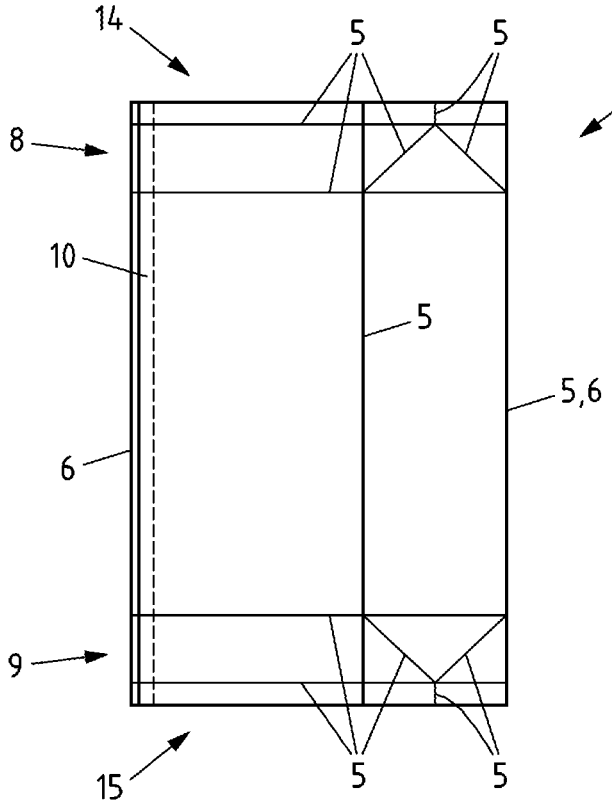
Fig.1B Prior Art

FIG. 1B shows the package sleeve 3 after the longitudinal borders 4 of the blank 1 have been sealed onto one another and after the subsequent flat-folding of the package sleeve 3 formed in this way. For visual reasons, the corresponding sealing seam 10 is provided near one of the two folding edges 6 of the packing sleeve 3, which are provided on the longitudinal edges of the flat-folded package sleeve 3 and are each formed from a fold line 5. Consequently, the shown package sleeve 3 has been folded flat along the folding edges 6, so that the front section or front side 11 of the flat-folded package sleeve 3 and the rear section or rear side 12 of the package sleeve 3 lie on top of each other. The package sleeves 3 can easily be stored when folded flat in this way. The subsequent unfolding around the four pre-folded fold lines 6 can then still be easily achieved. A package sleeve 3 with a rectangular cross-section is then obtained.

Figure 2:
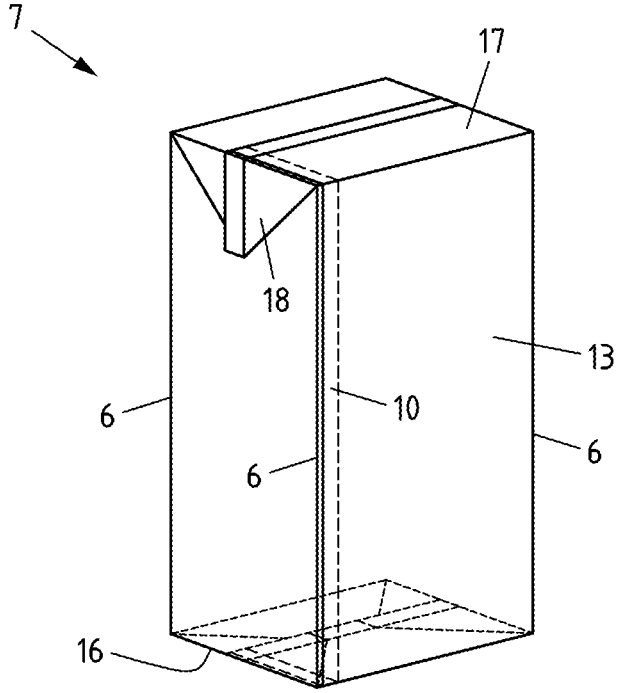
Fig.2 Prior Art
FIG. 2 shows a package of the prior art formed from the package sleeve according to FIG. 1B in a perspective representation.

In the following, the package 7 shown in FIG. 2 can be obtained by using the corresponding package sleeve 3. In the package 7, the four pre-folded fold lines 5 including the two folding edges 6 in the region of the sleeve 13 of the package 7 then form the edges of the package 7, just as the pre-folded fold lines 6 previously formed the edges of the package sleeve 3 in a similar way. The longitudinal ends 14, 15 of the package sleeve 3 have been folded and sealed to form the base 16 of the package 7 and the head 17 of the package 7. On the head 17 of the package, so-called package ears 18 are formed which are folded downwards and applied to the sleeve 13 of the package 7 and sealed or stuck on there. At the base 16, the corresponding package ears are folded inwards and can therefore no longer be recognised as such after the base 16 has been formed.

Figure 3:
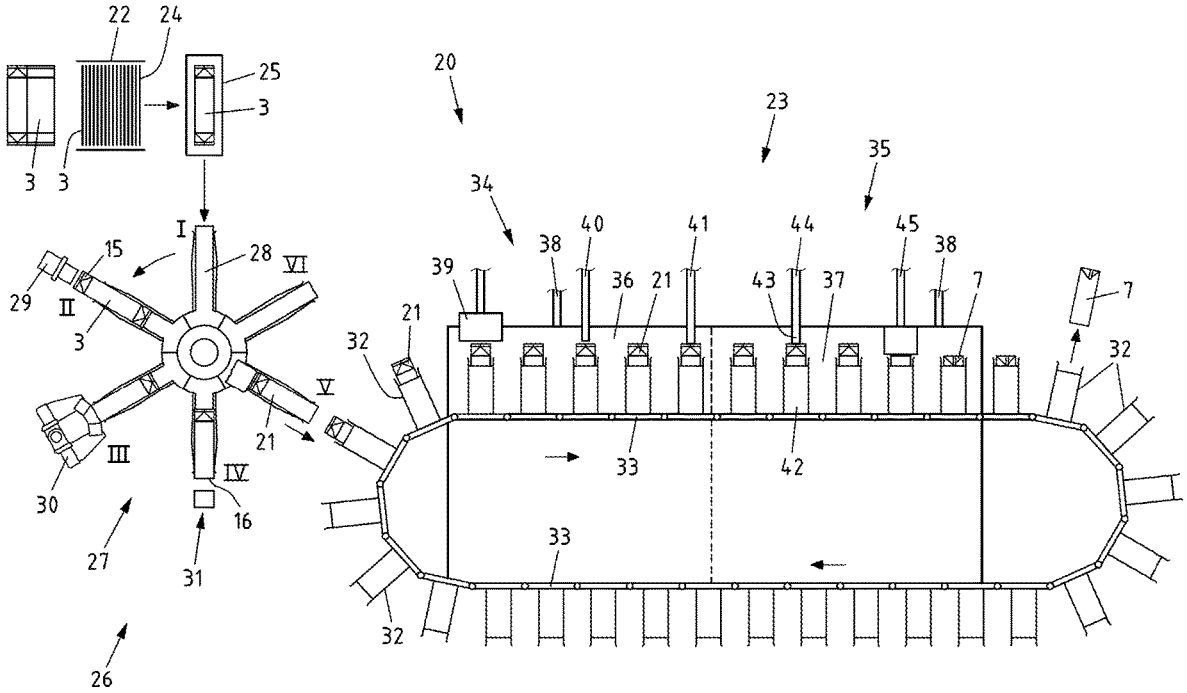
Fig.3 Prior Art
FIG. 3 shows a device for producing the package according to FIG. 2 from a package sleeve of the prior art according to FIG. 1B in a schematic representation.

FIG. 3 shows a device 20 for filling package bodies 21, in particular with flowable foodstuffs, to form packages 7, i.e. a so-called filling machine, comprising a magazine 22 for holding package sleeves 3 ready and a device for forming package bodies 21 from the package sleeves 3, which are closed on one side and can thus receive a flowable foodstuff, for example, through the remaining opening. The device 20 shown and in this respect preferred also has a row of parallel processing lines, of which only one processing line 23 is shown in FIG. 3. Each processing line 23 is assigned a magazine 22 with a stack 24 or a bundle of package sleeves 3 folded flat around two of the fold lines 5, forming the folding edges 6. As described above, the package sleeves 3 are formed from blanks 1 of a packaging material laminate 2 whose longitudinal borders 4 are sealed onto each other. In a moulding station 25, the package sleeves 3 are unfolded. The package sleeves 3 are unfolded by pulling a later side surface of the corresponding package sleeve 3 away from the stack 24 and folding around the pre-folded fold lines 5, which form the edges or the folding edges 6 of the package sleeve 3 and of the later package 7. If required, an application device could also be provided for applying spouts, which are not shown, to the package sleeves 3.

The device 26 for forming the package 7 has a mandrel wheel 27, which, in the case shown and in this respect preferred, comprises six mandrels 28 by way of example and rotates anticlockwise cyclically, i.e. gradually. A package sleeve 3 is pushed onto the mandrel 28 in the first mandrel wheel position I. The mandrel wheel 27 is subsequently rotated further to the next mandrel wheel position II, in which the longitudinal end 15 of the package sleeve 3 protruding from the mandrel 28 is heated with hot air via a heating unit 29. In the next mandrel wheel position III, the heated longitudinal end 15 of the package sleeve 3 is pre-folded by a press 30 and, in the following mandrel wheel position IV, is closed tightly in the folded position by a sealing device 31, in particular to form a base 16. In this way, a package body 21 is obtained which is closed on one side and is removed from the mandrel 28 in the following mandrel wheel position V and transferred to a cell 32 of a continuous transport device 33 guided in a circle. No work step is assigned to the mandrel 28 in the next mandrel wheel position VI. The number of mandrel wheel positions or mandrels 28 and the processing steps provided there can, if required, deviate from the depiction according to FIG. 3 and the associated description. In addition, in at least one further mandrel wheel position, a spout can also be connected to the packaging material laminate if required. The longitudinal end of the package sleeve closed on the mandrel wheel is then preferably the head of the later package. Whether the package body is filled through the later head or through the later base only plays a minor role here.

The package body 21 taken from the mandrel wheel is transported through a filling machine 34 with the open longitudinal end facing upwards in the associated cell 32, in particular a cell chain. In this case, the package body enters an aseptic chamber 35 comprising a sterilisation zone 36 and a filling and sealing zone 37, through which the package bodies 21 are transported from left to right in the transport direction symbolised by the arrows. The package bodies 21 do not have to be transported in a straight line, but can also be transported in at least a curve or even in a circle.

The aseptic chamber 35 is supplied with sterile air via corresponding sterile air connections 38. The packing bodies 21 are preheated successively by a preheating device 39 by hot sterile air being blown at them. The package bodies 21 are then sterilised using a sterilising device 40, preferably using hydrogen peroxide, whereupon the package bodies 21 are dried by a drying device 41 through application of sterile air and, after the transfer from the sterilisation zone 36 into the filling and sealing zone 37, brought into a filling position 42 below a filling outlet 43. The package bodies 21 are successively filled there with foodstuffs 44. The filled package bodies 21 are then closed with a closing device 45 by folding the top region of the package body 21 and sealing. The filled and closed packages 7 are then removed from the cells 32 of the transport device 33. The now-empty cells 32 are moved further by the transport device 33 in the direction of the mandrel wheel 27 in order to receive further package bodies 21 there.

Figure 4A:
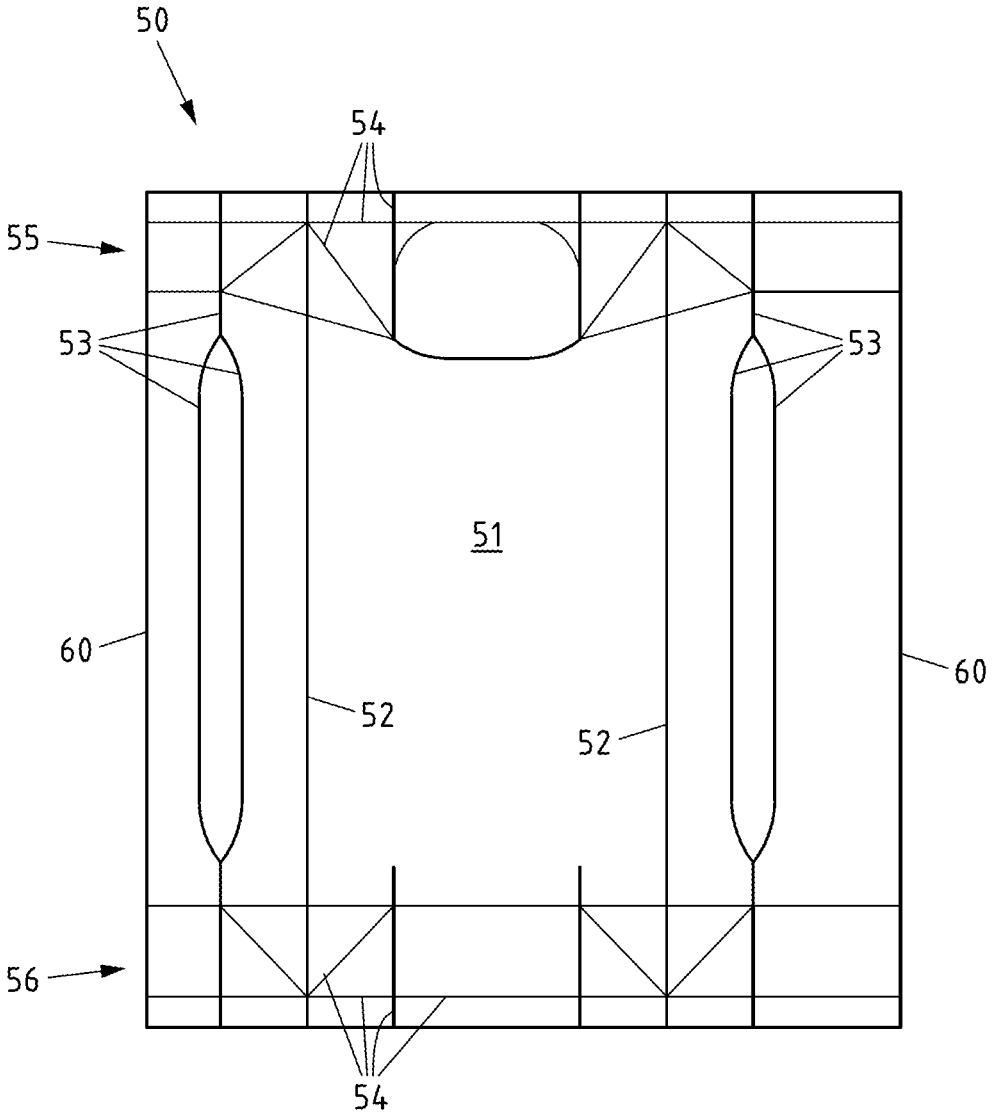
FIGS. 4A-C show a blank of a packaging material laminate and a package sleeve formed from the blank in plan view.

FIG. 4A shows a further blank 50 of a packaging material laminate 51, which blank is generally similar to the blank 50 according to FIG. 1A with regard to the packaging material laminate 51, the blank 50 and the fold lines 52, 53, 54. The difference, however, is that the fold lines 52, 53, 54, in particular creasing lines, are arranged and designed differently. Thus, in particular, only two fold lines 52 are provided, extending in a straight line in the longitudinal direction and over the entire longitudinal extent of the blank 50. Two further fold lines 53 are divided in sections in the longitudinal direction of the blank 50 and enclose a section of the blank there. In the corresponding region, the fold lines 53 run parallel to each another, but this is not mandatory. In addition, the top border 55 and the bottom border 56 of the blank 50 are provided with fold lines 54. The fold lines 54 of the bottom border 56 are used to form a base 57, while the fold lines 54 of the top border 55 are used to form a head 58 of a package 59.

Figure 4B:
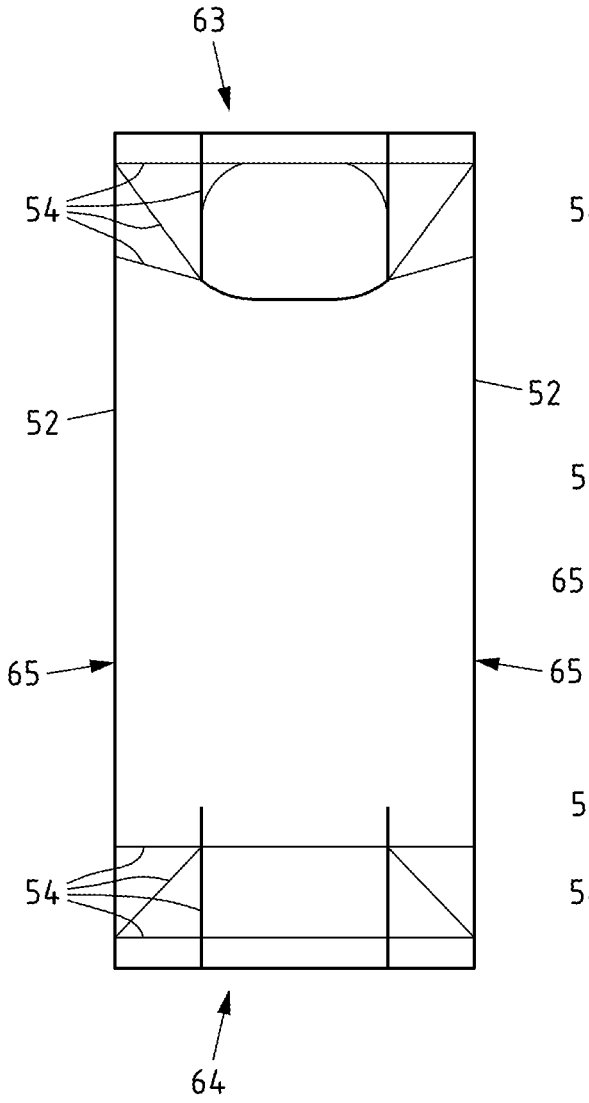
Figure 4C:
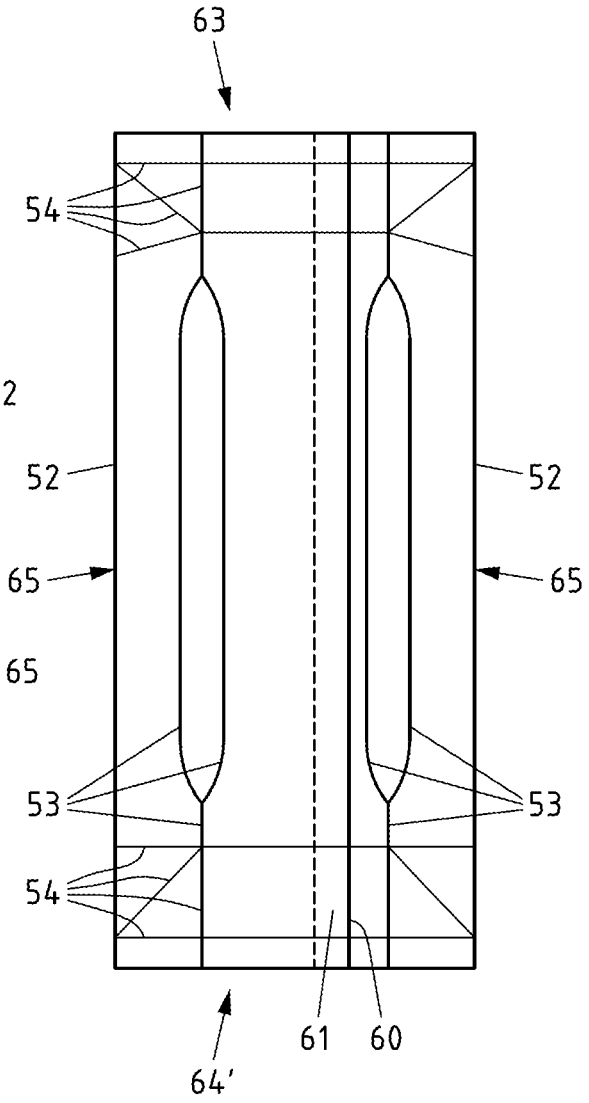

The blank 50 is sealed along the longitudinal edges 60, forming a sealed seam 61, to form a package sleeve 63, whose front side 64 and rear side 64' are shown in FIGS. 4B-C. The package sleeve 63 is folded on the two fold lines 52 running in a straight line in the longitudinal direction of the package sleeve 63, forming the folding edges 65, so that the front side 64 and the rear side 64' of the package sleeve 63 abut against each other.

Figure 5:
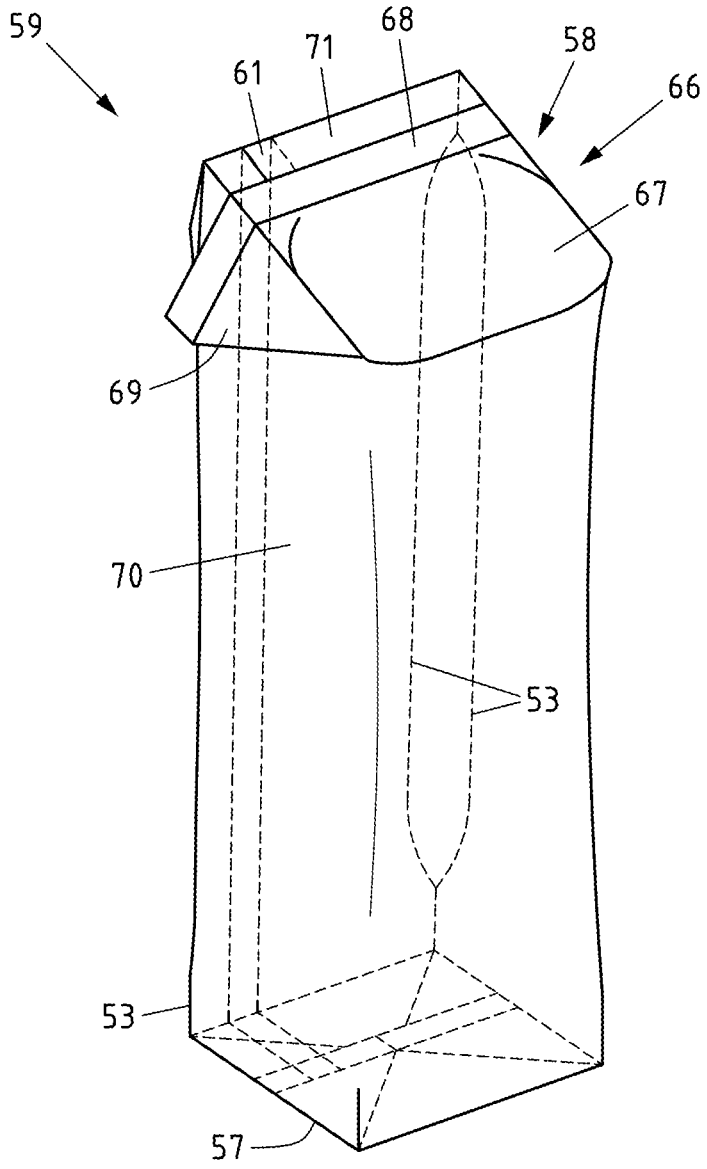
FIG. 5 shows a package formed from the package sleeve according to FIGS. 4B-C in a perspective representation.

The package 59 shown in FIG. 5 can be formed by using the corresponding package sleeve 63. The package 59 has a flat base 57, which is perpendicular to the longitudinal extent of the package 59. The head 58 of the package 59, on the other hand, is oriented obliquely with respect to the longitudinal extent of the package 59 and thus forms a package gable 66. The package gable 66 has a larger front gable surface 67, which is larger than the rear, smaller gable surface 71 arranged on the other side of the sealing seam 68. The sealing seam 68 and adjacent sections of the head 58 form, on opposite sides of the package 59, package ears 69, which are folded downwards and applied or sealed onto the sleeve 70 of the package 59. A larger opening section, a larger weakening and/or a larger spout may be provided on the larger gable surface 67 if required. For the sake of simplicity, neither an opening section nor a weakening or a spout is shown. A noteworthy feature of the package 59 is that no continuous fold lines 52 or folding edges 65 are provided on the front longitudinal borders of the package 59. Another special feature of the package 59 is that the folding edges 65 are not provided on any longitudinal border of the package 59 for flat-folding the package sleeve 63. Rather, the folding edges 65 are received in the surfaces between the longitudinal borders or longitudinal edges of the package 59. In other words, the folding edges 65 of the package sleeve 63 are folded back again and thus no longer form any folding edges of the package 59. In addition, fold lines 52, 53, 54 extending in a straight line in the longitudinal direction of the package are not provided on the rear edges of the sleeve 70 of the package 59. Due to the division of the fold lines 53, said fold lines do not run over the entire longitudinal extent of the sleeve 70 of the package 59 in a straight line and also do not run, at least in sections, along the edges of the sleeve 70 of the package 59, but in regions adjacent thereto.

Figure 6:
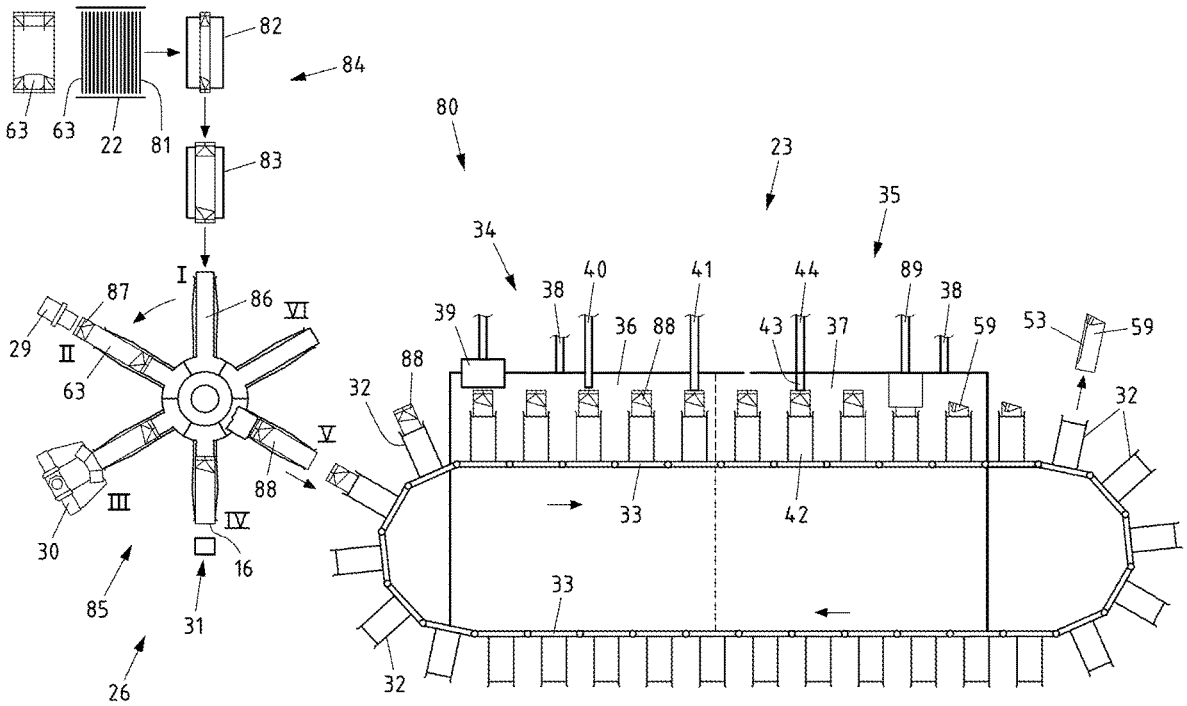
FIG. 6 shows a device for producing the package according to FIG. 5 from a package sleeve according to FIGS. 4B-C in a schematic representation.

FIG. 6 shows the device 80 for filling such packages 59. The device 80 corresponds largely to the device 20 shown in FIG. 3, so that substantially the differences between the device 80 shown in FIG. 6 and the device 20 shown in FIG. 3 are described below in order to avoid unnecessary repetitions. For this reason, the same components in FIGS. 3 and 6 are identified by the same reference signs. Also in the case of the device shown in FIG. 6, a mandrel wheel with a different number of mandrels and/or a different number of mandrel wheel positions could alternatively be provided. In this regard, it would be particularly preferable, for example, to provide a mandrel wheel with only four mandrels and/or only four mandrel wheel positions.

One difference, for example, is that the package sleeves 63 shown in FIGS. 4B-C are provided in the magazine 22 of the device 80 in the form of stack 81, the package sleeves being thus pre-folded only on two fold lines 52 extending in a straight line over the entire longitudinal extent of the package sleeve, and these fold lines 52 form the folding edges 65 of the package sleeves 63 around which the package sleeves 63 are folded flat. Furthermore, in addition to the device 20 shown in FIG. 3, the device 80 shown in FIG. 6 also has a pre-folding device 82 for pre-folding the package sleeves 63 after the package sleeves 63 have been removed from the stack 81 of the package sleeves 63, and a unfolding device 83 for unfolding the package sleeves 63 which are removed from the stack 81 of package sleeves 63 of the magazine 22. In the device 80 shown and in this respect preferred, the pre-folding device 82 and the unfolding device 83 are combined to form a moulding station 84 for moulding the unfolded package sleeve 63 to be transferred to the mandrel wheel 85. However, it is also possible for only the pre-folding device 82 or only the unfolding device 83 to be provided. Only after passing through the moulding station 84 are the package sleeves 63 pushed onto the mandrels 86, whereby the longitudinal ends 87 of the package sleeves 63 can be folded and pressed against the mandrel 86 to close the longitudinal end 87, in particular to seal it in a liquid-tight manner. Thus, package bodies 88 are finally formed which are delivered to the cells 32 of the transport device 33, in this case in the form of a cell chain.

Figure 7:
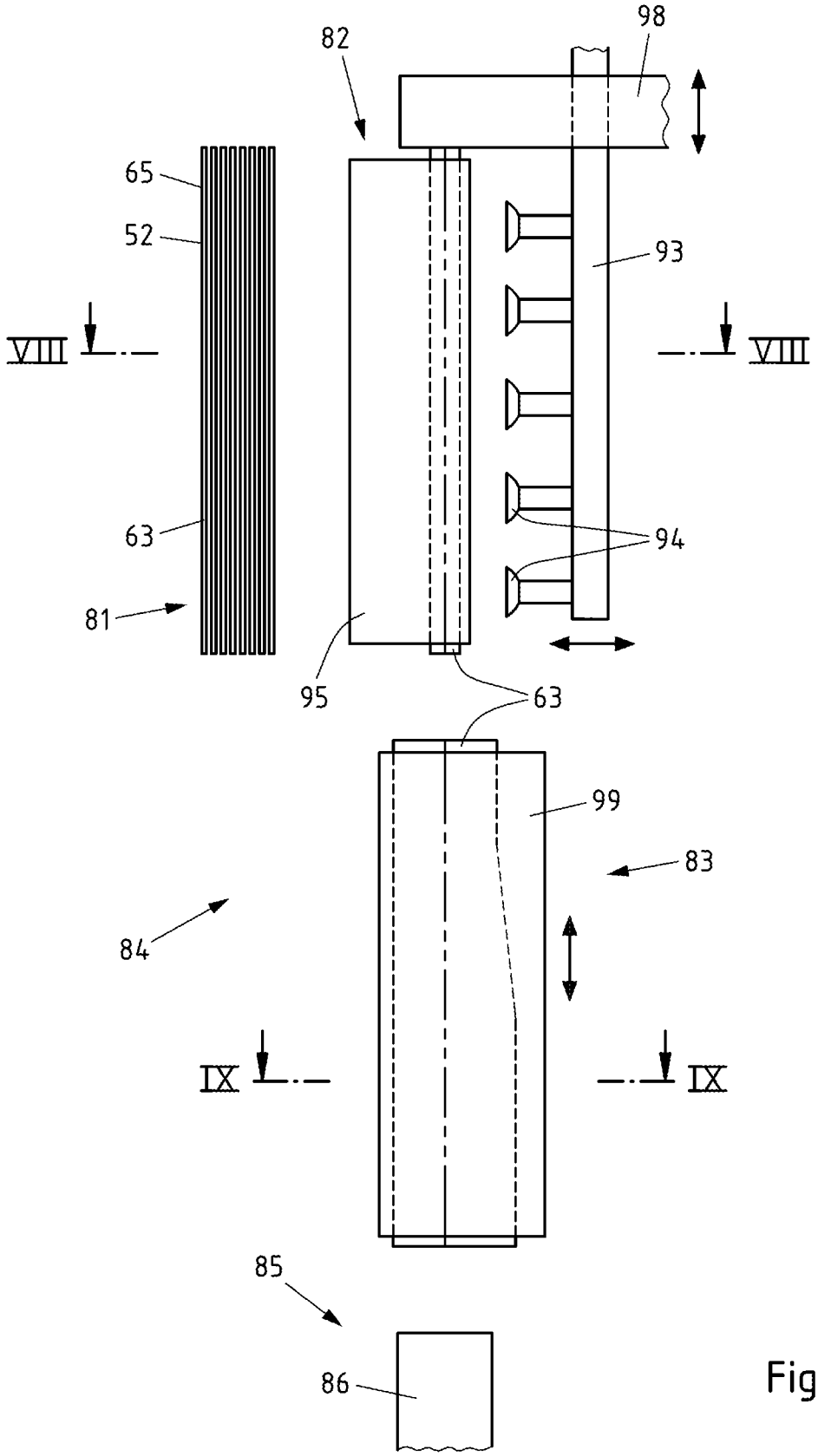
FIG. 7 shows the unfolding of the package sleeve in a moulding station in a schematic side view.
Figure 8:
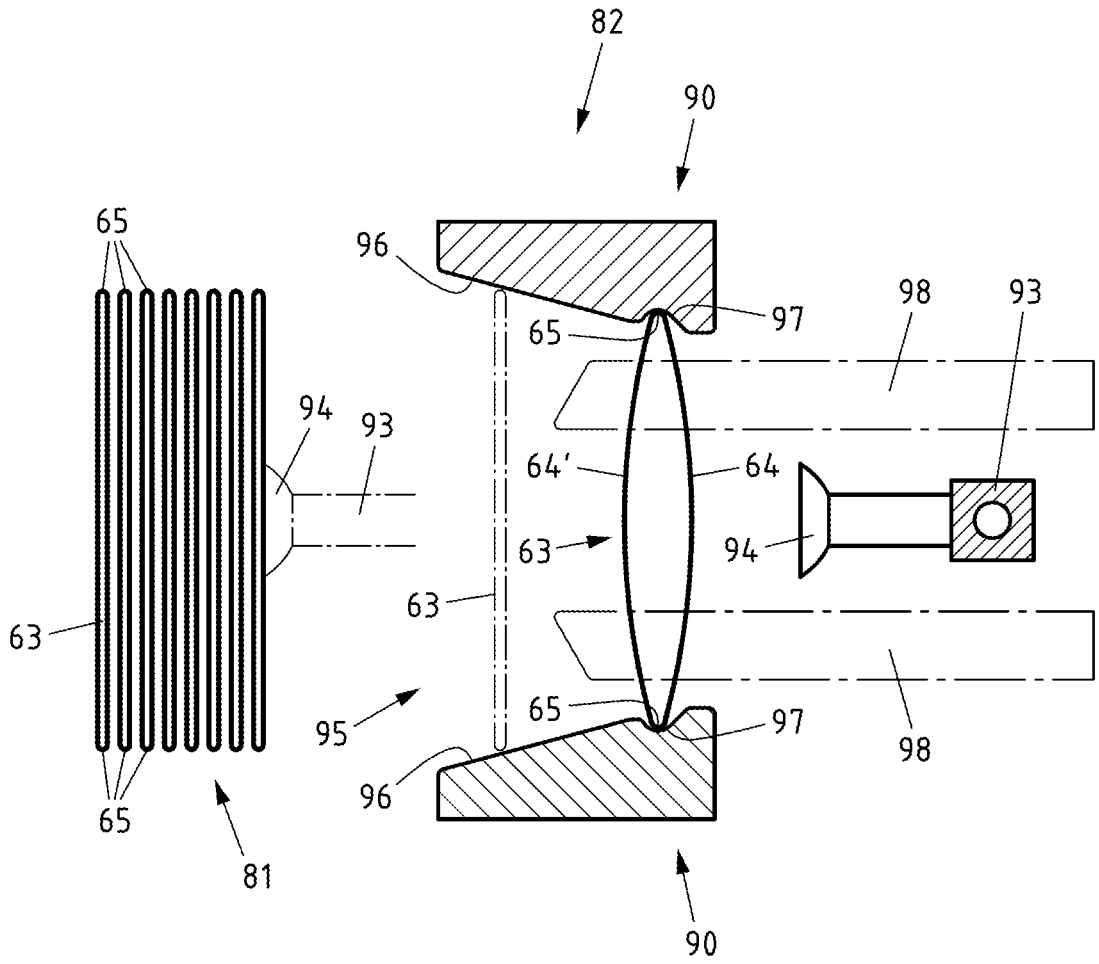
FIG. 8 shows the intended pre-folding of the package sleeve in a sectional view in accordance with the section plane VIII-VIII from FIG. 7, FIGS. 9A-C show the pre-folding of the package sleeve in the case of non-intended behaviour of the package sleeve in a sectional view in accordance with the section plane VIII-VIII from FIG. 7, FIGS. 10A-B show the moulding of the package sleeve in a sectional view in accordance with the section plane IX-IX from FIG. 7, FIGS. 11A-B show the moulding station from FIG. 7 in a perspective view and a side view.

FIG. 7 schematically shows the moulding station 84 of the device 80 shown in FIG. 6. The moulding station 84 uses the package sleeves 63, which, folded together around two fold lines 52 or folding edges 65, are held ready in a stack 81 of package sleeves 63 in a magazine 22. The stack 81 is held in a magazine 22 which is not shown. The moulding station 84 comprises a gripper 93 with suction cups 94, which grips the front side of the front flat-folded package sleeve 63 of the stack 81 and pulls the package sleeve 63 along a withdrawal transport path into and through a channel 95 of the pre-folding device 82. The pre-folding device 82 is shown in particular in the sectional view of the moulding station 84 according to FIG. 8. The dotted line shows the gripper 93 gripping a package sleeve 63 of the stack 81; for this purpose a vacuum can be drawn in the suction cups by extracting air. The stack 81 is held in a magazine 22 which is not shown. The gripper 93 then moves backwards in a straight line together with the package sleeve 63 and pulls the package sleeve 63 in a straight line into a channel 95 tapered transversely to the package sleeve 63. In the channel 95, the folding edges 65, around which the package sleeve 63 has been folded flat, come into contact with the boundaries 96 of the channel 95. The folding edges 65 finally press from the inside against the channel 95, which in return compresses the package sleeve 63 slightly and thus unfolds it, and the more the package sleeve 63 is pulled or transported through the channel 95, the more it is unfolded. At the rear end of the channel 95, grooves 97 aligned in the longitudinal direction of the folding edges 65 are provided on both sides of the channel 95 in receptacles 90, which form undercuts in the transport direction of the package sleeves 63 along a withdrawal transport path and into which the package sleeve 63 engages in the corresponding position with the folding edges 65. In principle, a channel 95 could also be dispensed with and the package sleeves 63 could be transferred directly to the grooves 97. In addition, the suction cups 94 and thus the gripper 93 could now be detached from the package sleeve 63 if the package sleeve 63 is held slightly unfolded in the grooves 97 as shown in FIG. 8.

Alternatively, the channel 95 and/or the at least one receptacle 90 could also be directly connected to the magazine 22 or be part of the magazine 22. A division into two separate components is therefore preferred in principle but not necessary.

Figure 9A:
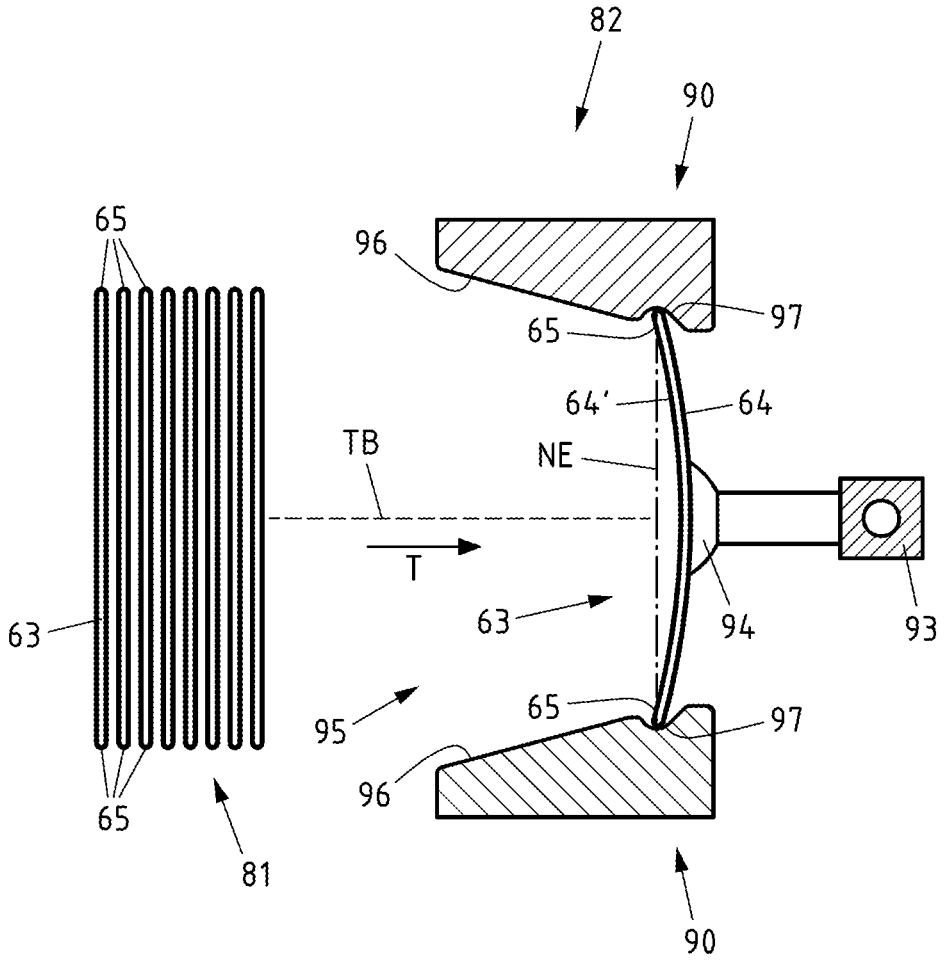
Figure 9B:
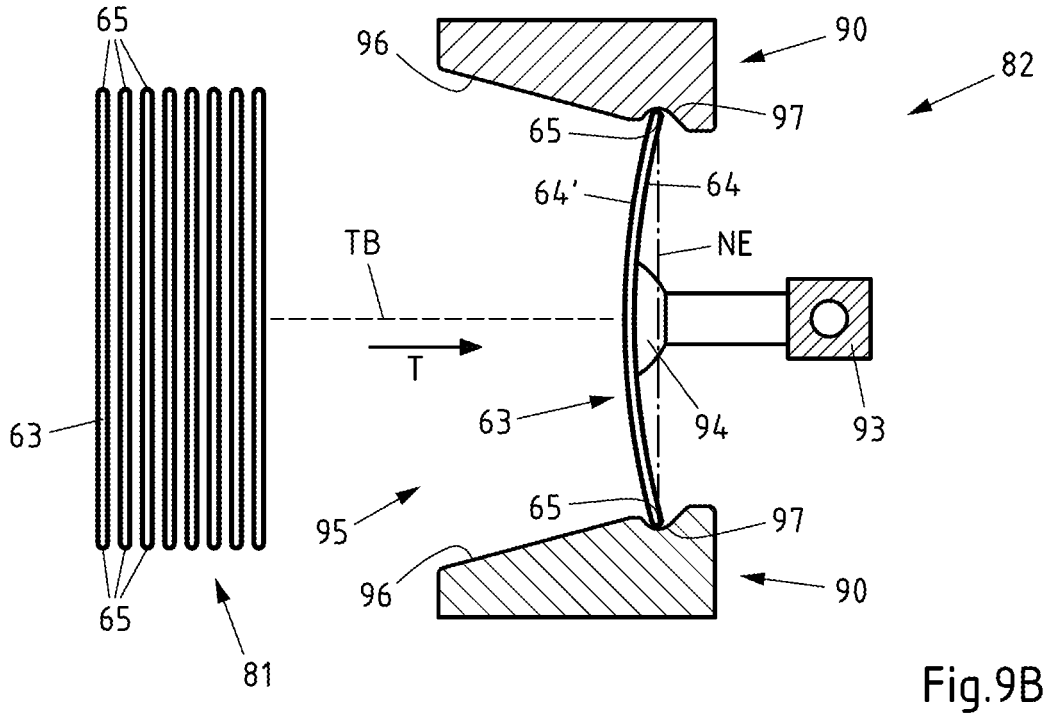
Figure 9C:
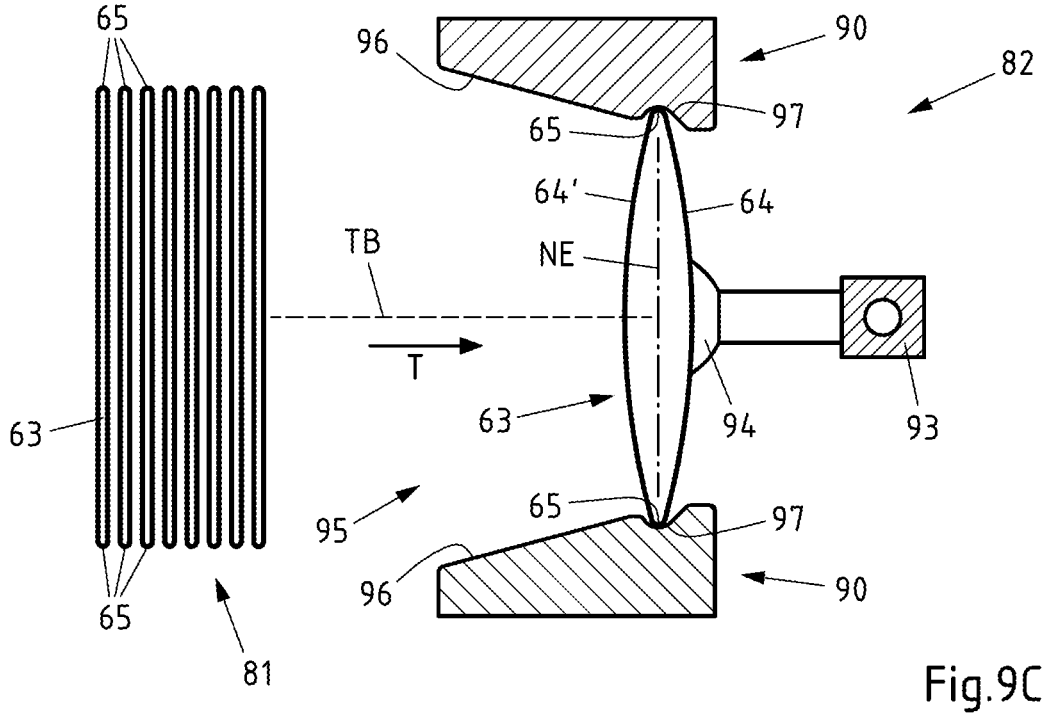

In some cases, however, the package sleeve 63 may not unfold as described. As shown in FIG. 9A, the package sleeve 63 can be pulled by the gripper 93 in the transport direction T of the package sleeves 63 along the transport path TB into the grooves 97. The front side 64 and the rear side 64' of the package sleeve 63 are in this case not bent in opposite directions and the package sleeve 63 is not unfolded. As a result of the compression of the package sleeve 63, the front side 64 and the rear side 64' of the package sleeve 63 are bent in the same direction, namely in the transport direction T of the package sleeves 63, without the package sleeve 63 being significantly unfolded. According to FIG. 9A, both the front side 64 and the rear side 64' of the package sleeve 63 are arranged in the same way as the suction cup 94, viewed in transport direction T, behind the groove plane NE which connects the grooves 97. For this reason the gripper 93 is moved back from the end position shown in FIG. 9A, in which the gripper 93 still holds the front side 64 of the package sleeve 63, while the folding edges 65 are positioned in the grooves 97 against the actual transport direction T along the withdrawal transport path TB, up to the intermediate position shown in FIG. 9B. Once in this intermediate position, the gripper 93 has bent the front side 64 of the package sleeve 63 as well as the rear side 64' of the package sleeve 64 against the transport direction T. Both the rear side 64' and the front side 64 of the package sleeve 63 as well as the suction cup 94 of the gripper 93, viewed in transport direction T, are located in front of the groove plane NE, which connects the grooves 97. The gripper 93 is subsequently moved again along the withdrawal transport path TB in the transport direction T. The rear side 64' of the package sleeve 63 remains in the position shown in FIG. 9B, i.e. in the transport direction T in front of the groove plane NE, and the front side 64 of the package sleeve 63 is moved again in the transport direction T behind the groove plane NE, the front side 64 of the package sleeve 63 bending in the transport direction T. Consequently, at the latest now, the front side 64 and the rear side 64' of the package sleeve 63 are bent in different directions, so that the package sleeve 63 is accordingly, as shown in FIG. 9C, held ready for transfer in the grooves 97 in an at least partially unfolded manner. This time the gripper 93 can release the package sleeve 63 when it reaches the end position, for example by the vacuum in the suction cups 94 being removed.

The principle described above should be applied by analogy to package sleeves 3, for example in accordance with 1B, in which, between the folding edges 6, at least on the front side and/or the rear side of the flat-folded package sleeve 3, at least one additional fold line 5 running at least substantially parallel to the folding edges 6 is provided. As a result of the fold line 5, the corresponding front side and/or the rear side of the package sleeve 3 tends not to be bent as in FIGS. 8 and 9, but rather kinked around the fold line 5, since the package sleeve 3 can easily be folded around this fold line 5. In the event that the corresponding package sleeve 3 unfolds easily while the package sleeve 3 is transferred from the stack to the grooves 97 by means of the gripper 93, the front side of the package sleeve 3 will be kinked according to FIG. 8 in the transport direction T and/or the rear side of the package sleeve 3 will be kinked against the transport direction T. If this is not the case, the front side and/or the rear side of the package sleeve 3 can be kinked across the groove plane NE in the transport direction T as in FIG. 9A, or, in the transport direction T, in front of the groove plane NE against the transport direction T as in FIG. 9B. After the gripper 93 has released the package sleeve 3, the rear side can then be kinked against the transport direction T and/or the front side can be kinked in the transport direction 3 as in FIG. 9C.

Alternatively or in addition to the described movement of the gripper 93 for reliable, at least partial unfolding of the package sleeve 63 in the grooves 97 of the receptacle 90, the grooves 97 or the at least one receptacle 90 can also be moved. If the grooves 97 or the receptacle 90 are each moved in the opposite direction to that described for the gripper 93, the same relative movements between the grooves 97, the gripper 93 and the package sleeve 63 are achieved with respect to the package sleeves 63, so that the package sleeve 63 is unfolded safely and reliably at least partially in the grooves 97.

Figure 10A:
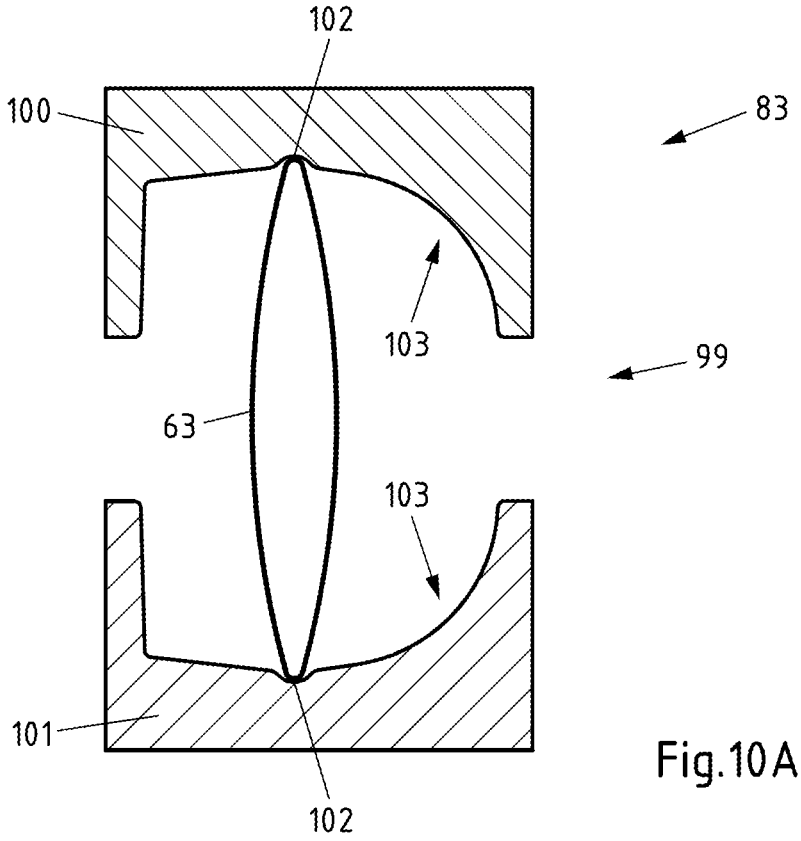
Figure 10B:
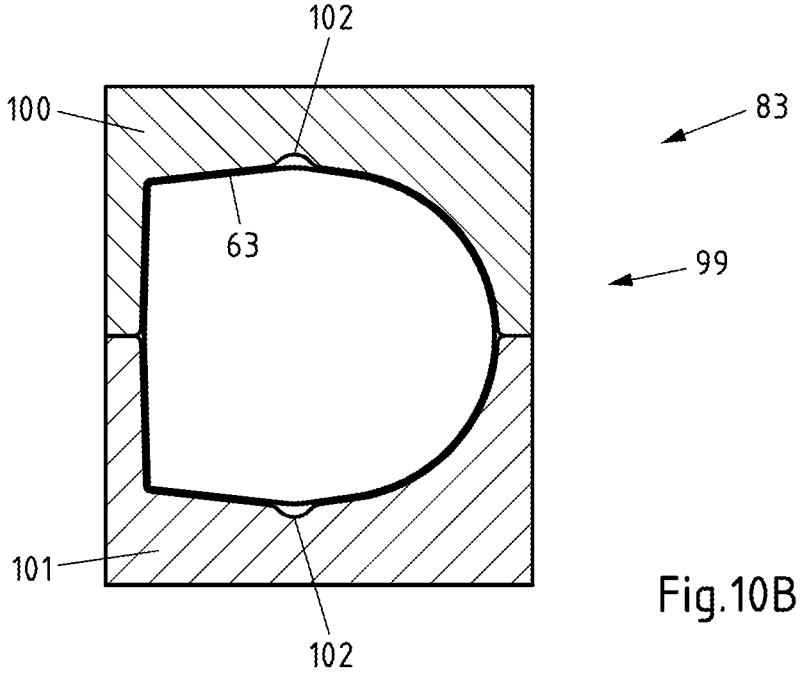

Two fingers 98 are arranged above the package sleeve 63 positioned in this way, as shown in particular in FIG. 7. These fingers 98 now move downwards and press the package sleeve 63 downwards into a mould 99 of the unfolding device 83 to unfold the package sleeve 63. The mould 99 of the unfolding device 83 is shown in particular in FIGS. 10A-B in section. FIG. 10A shows an example of the mould 9 with two mould halves 100, 101 in an open position. In this position, the pre-folded package sleeve 63 is taken by the mould 99, for which purpose grooves 102 are also provided in the shown and in this respect preferred mould 99, into which grooves the folding edges 65 of the package sleeve 63 engage. Subsequently the mould 99 is closed and enters the closed position shown by way of example in FIG. 10B. The package sleeve 63 is unfolded and at least substantially contacts the inner contour 103 of the mould 99. In this way, the package sleeve 63 can be brought at least approximately into the later shape of the package 59. If required, other contour shapes may also be provided instead of the contour shape shown, depending on the mould in which the packages are to be produced. In FIG. 7, the double arrow and the mandrel 86 of a mandrel wheel 85 provided below the mould 99 indicate that the mould 99, after closing, moves downwards over the mandrel 86 and transfers the unfolded package sleeve 63 to the mandrel 86 or pushes it onto the mandrel 86.

Figure 11A:
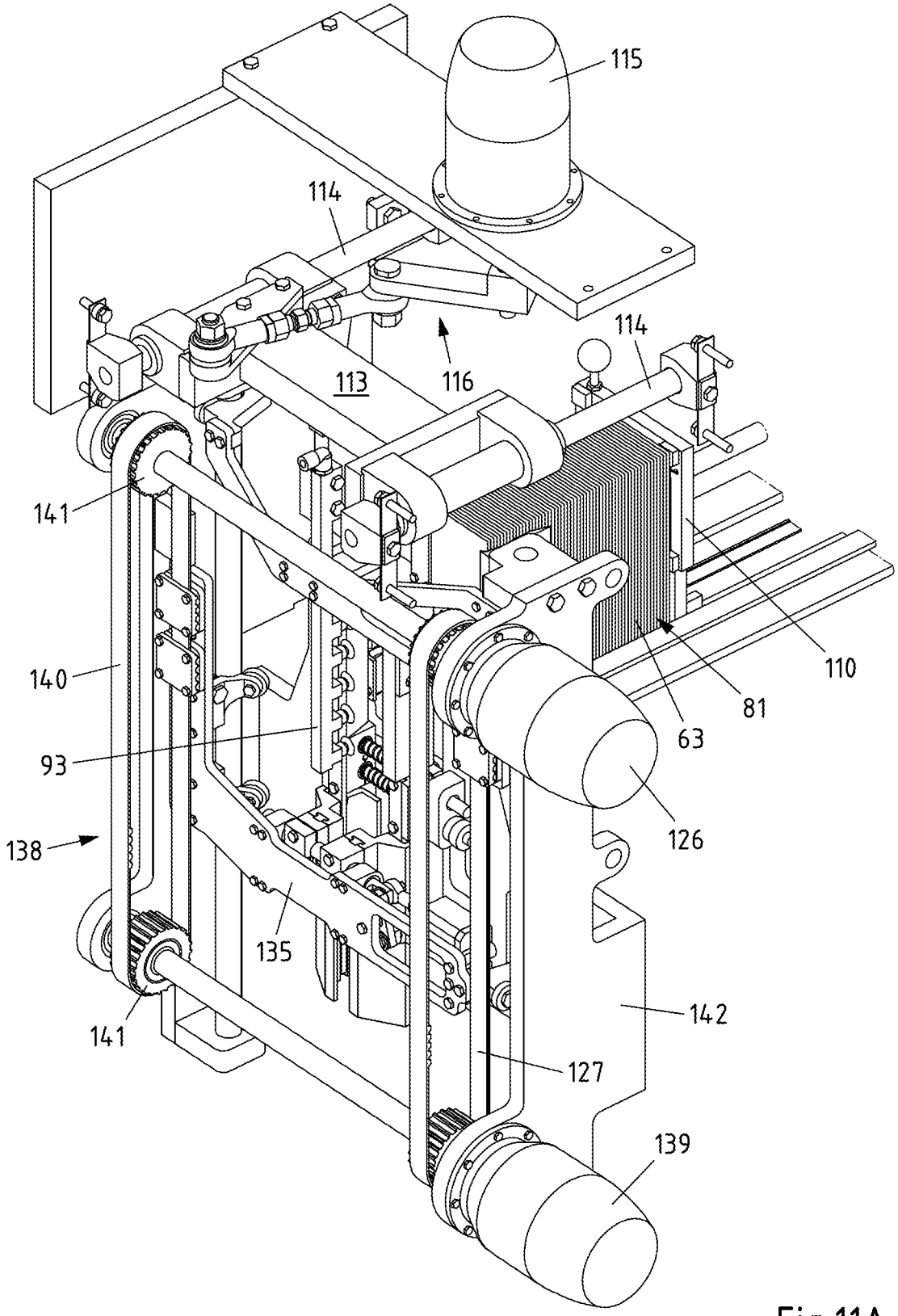
Figure 11B:
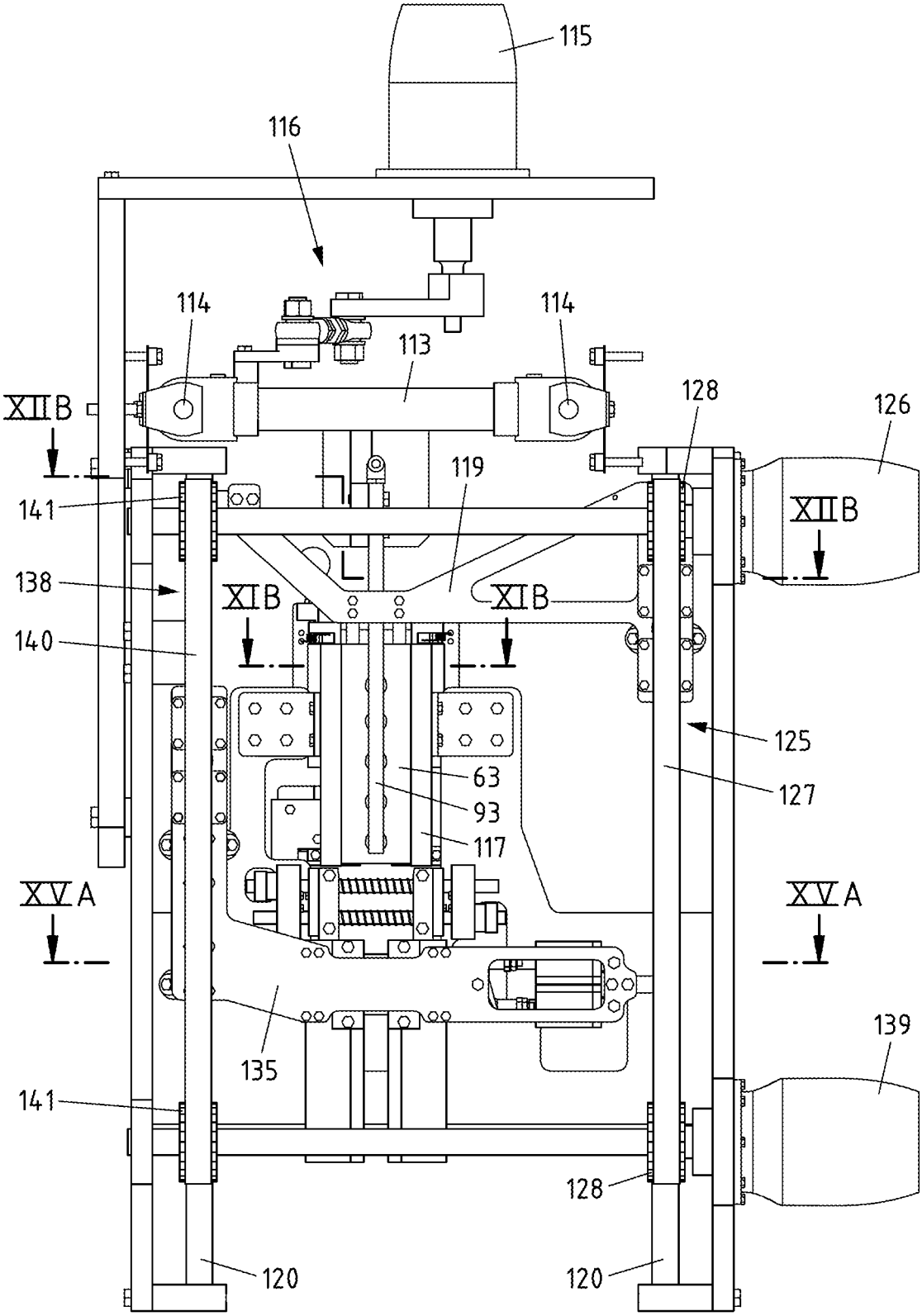
Figure 12A:
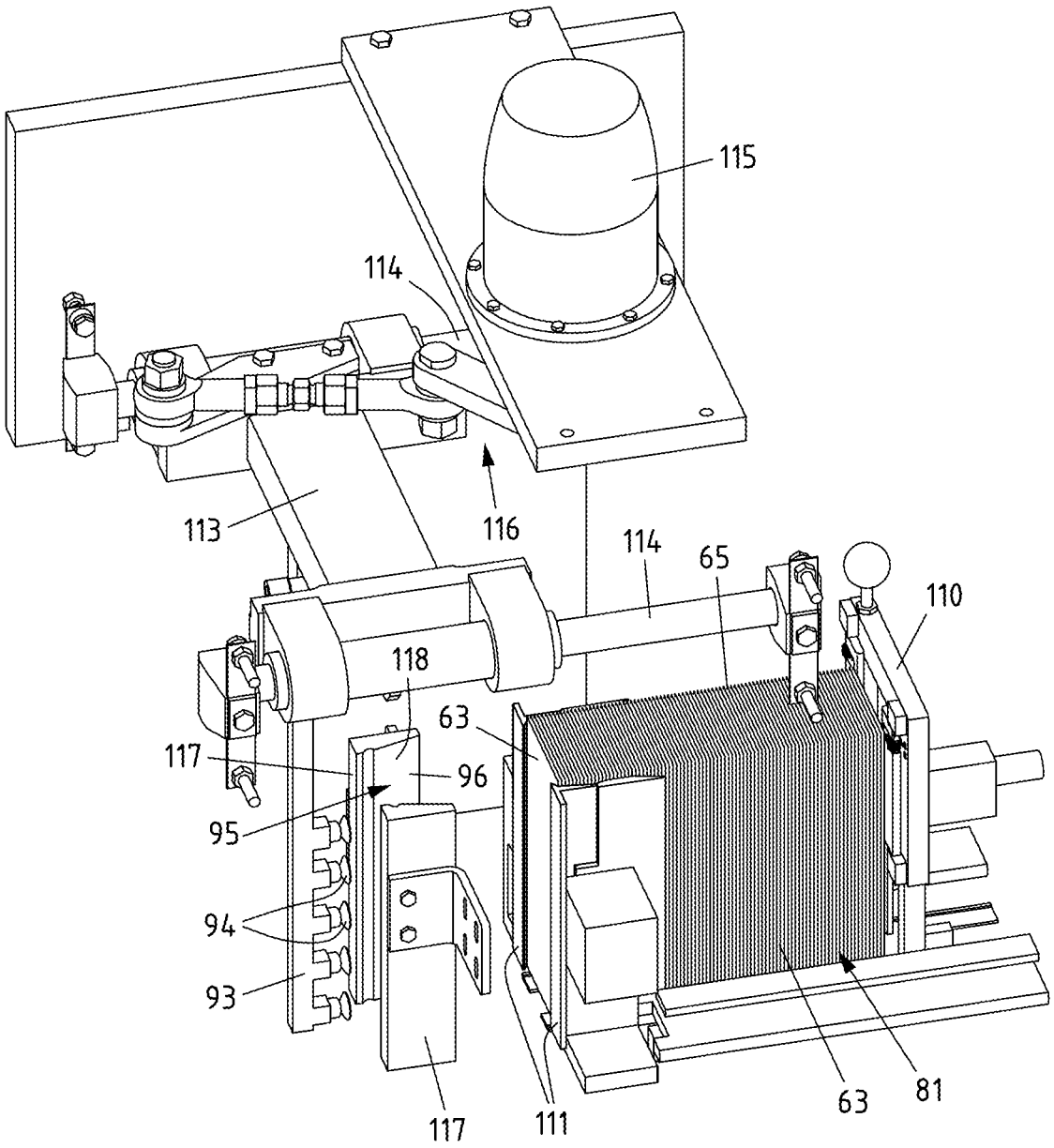
FIGS. 12A-B show the pre-folding device of the moulding station from FIG. 10 in a perspective view and a sectional view from above.
Figure 12B:
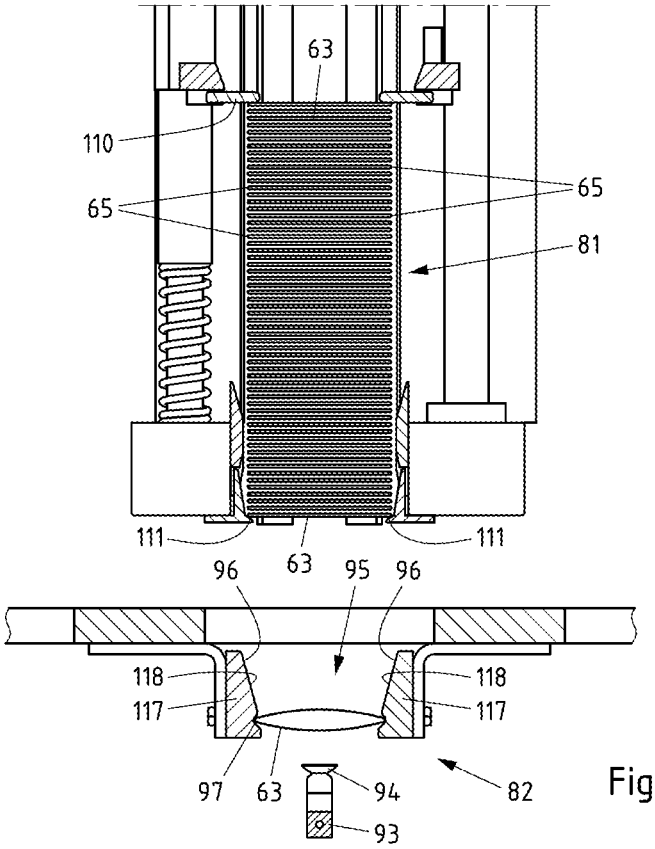

FIGS. 11A-B shows in detail the moulding station 84, which is only shown schematically in FIG. 7 for better clarity. A stack 81 of package sleeves 63 is stored in the magazine 22. This is also shown in detail in FIGS. 12A-B. A pusher 110 is provided behind the stack 81 and presses the stack 81 against stops 111 on both sides of the stack 81 in order to position the front package sleeve 63 precisely. The pusher 110 is pressed against the rear side of the stack 81 by the restoring force of a spring means as required, even if the length of the stack 81 decreases. However, the spring means can also be dispensed with or replaced by other devices. The front side of each front package sleeve 63 can be gripped by a gripper 93. For this purpose, the gripper 93 shown and in this respect preferred has suction cups 94, which are applied to the front side of the front package sleeve 63. As a result, the suction cups 94 are closed and can be evacuated at least partially, forming a vacuum. Since the package sleeves 63 are held in this way on the suction cups 94, the package sleeves 63 can be pulled off the front of stack 81. In this case the package sleeves 63 are pulled past the stops 111. The gripper 93 shown and in this respect preferred moves in a straight line in the transport direction along the withdrawal transport path away from the stack 81 and through a channel 95. For this purpose, the gripper 93 is held on a carriage 113. The carriage 113 can be displaced along guides 114 and is held on the guides 114, which are rod-shaped. The carriage 113 is displaced forwards and backwards by a rotating motor drive 115, which is coupled to the carriage 113 by a lever mechanism 116, whereby the rotation of the drive 115 being converted into a forward and backward linear movement of the carriage 113.

The channel 95 shown and in this respect preferred is formed by two channel elements 117 laterally delimiting the channel 95. The gripper 93 can be moved through between the channel elements 117. The channel elements 117 form a channel 95 tapering away from the stack 81, in the rear region of which, viewed from the stack 81 of the package sleeves 63, a groove 97 is provided in each case which extends substantially parallel to the folding edges 65 of the package sleeves 63 in the stack 81 and in the vertical direction. The grooves 97 also extend all the way to the bottom border of the channel elements 117 and thus of the channel 95. The channel elements 117 form the boundaries 96 of the channel 95, which is formed between the channel elements 117. In addition, the channel elements 117 provide sliding surfaces 118 facing inwards into the channel 95. When the package sleeves 63 are pulled from the stack 81 through the channel 95, the folding edges 65 of the package sleeves 63 slide along the sliding surfaces 118 until the package sleeves 63 engage with the folding edges 65 into the grooves 97 of the channel elements 117.

The width of the channel 95 is slightly wider at the end facing the stack 81 of package sleeves 63 than the package sleeves 63 themselves. Further in the channel 95, the folding edges 65 press against the sliding surfaces 118, which is equivalent to the sliding surfaces 118 pressing against the folding edges 65 of the package sleeve 63. The folding edges 65 are thus pressed towards each other and the package sleeve 63 is thus partially unfolded. This is also referred to as pre-folding the package sleeves 63. The pre-folding is defined and reproducible due to the folding edges 65 engaging into the grooves 97. The part of the system comprising the channel 95 can therefore be referred to as the pre-folding device 82.

Figure 13A:
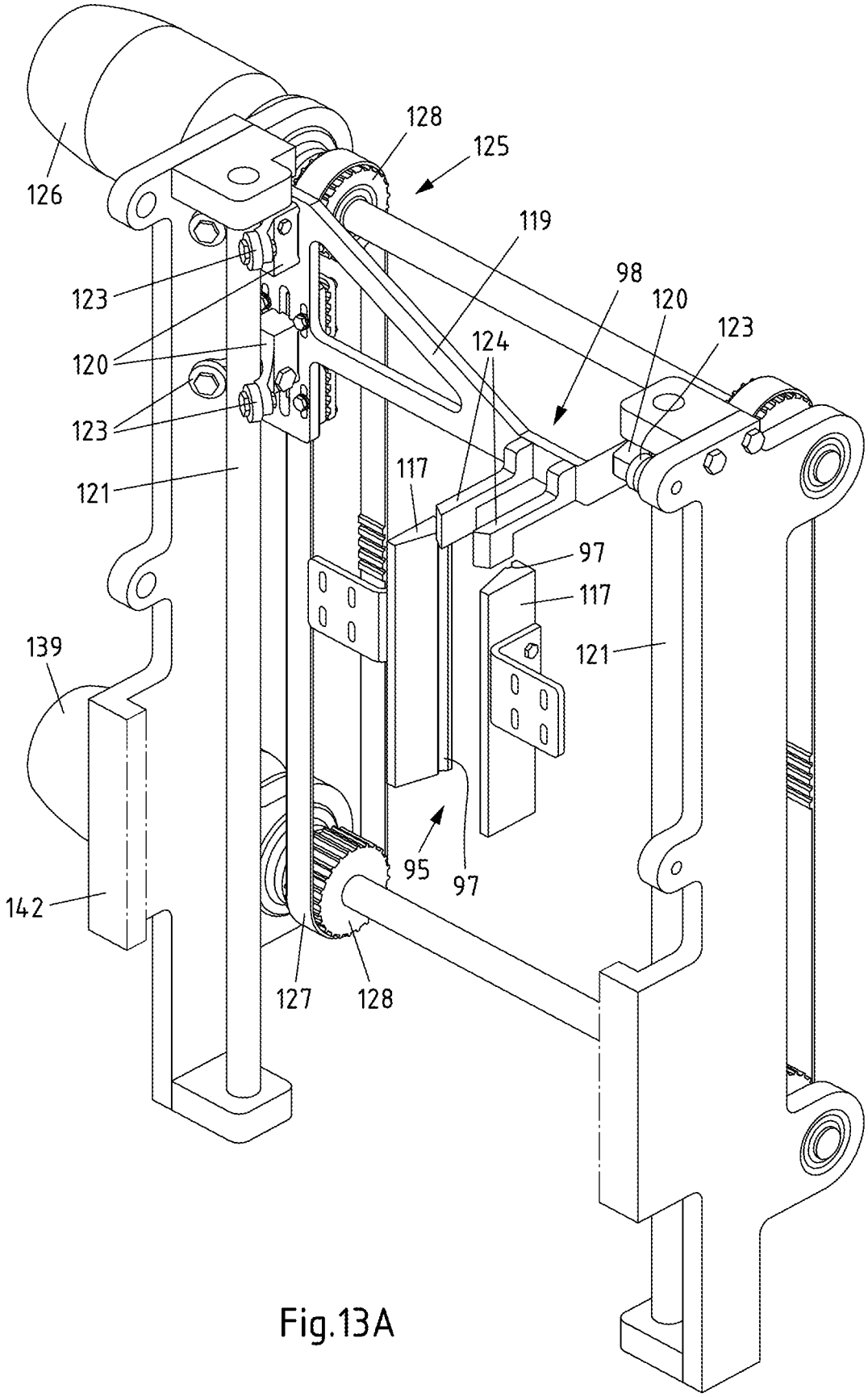
FIGS. 13A-B show the feeding device of the moulding station from FIG. 10 for feeding package sleeves from the pre-folding device to the unfolding device in a perspective view and a sectional view from above.
Figure 13B:
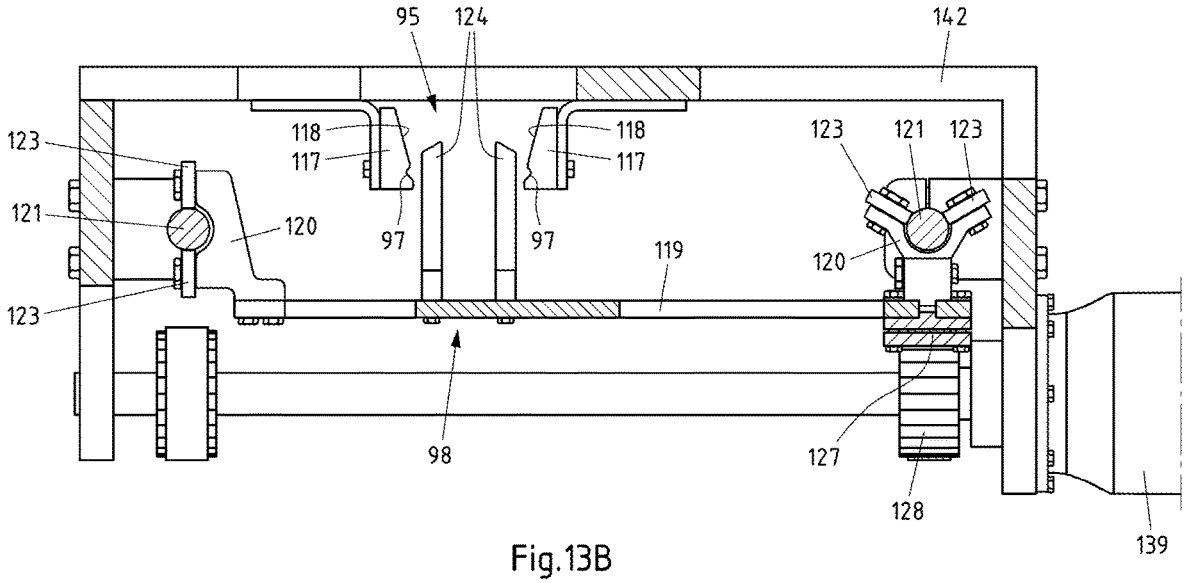

In particular, FIGS. 13A-B show a feeding device 98 of the moulding station 84, the object of which is to pass the package sleeves 63 held in the grooves 97 of the channel 95 downwards to an unfolding device 83, in which the package sleeves 63 are then completely unfolded. The feeding device 98 is held on a traverse 119, which is held by carriages 120 on lateral vertical guides 121 and can be moved up and down in the vertical direction. For this purpose, the carriages 120 have rollers 123, which can unroll on the lateral guides 121, which are rod-shaped. The feeding device 98 also has two fingers 124 arranged in a top position above the channel 95 or at least above the package sleeves 63 pulled through the channel 95 and held in the grooves 97. The feeding device 98 can be moved up and down in a controlled manner by a belt drive 125, which is motor-driven by a drive 126. The belt 127 is laid circumferentially as a closed belt 127 around two deflection rollers 128, of which one deflection roller can be driven in opposite directions by the motor drive 126 as required. When the package sleeves 63 are held in the grooves 97 of the channel 95, the feeding device 98 moves or the fingers 124 move downwards. In this case, the fingers 124 grip from above against the top longitudinal end of the package sleeve 63 and press the package sleeve 63 downwards along the grooves 97. Subsequently, the fingers 124 move upwards again and a further package sleeve 63 is pulled through the channel 95 into the grooves 97.

Figure 14A:
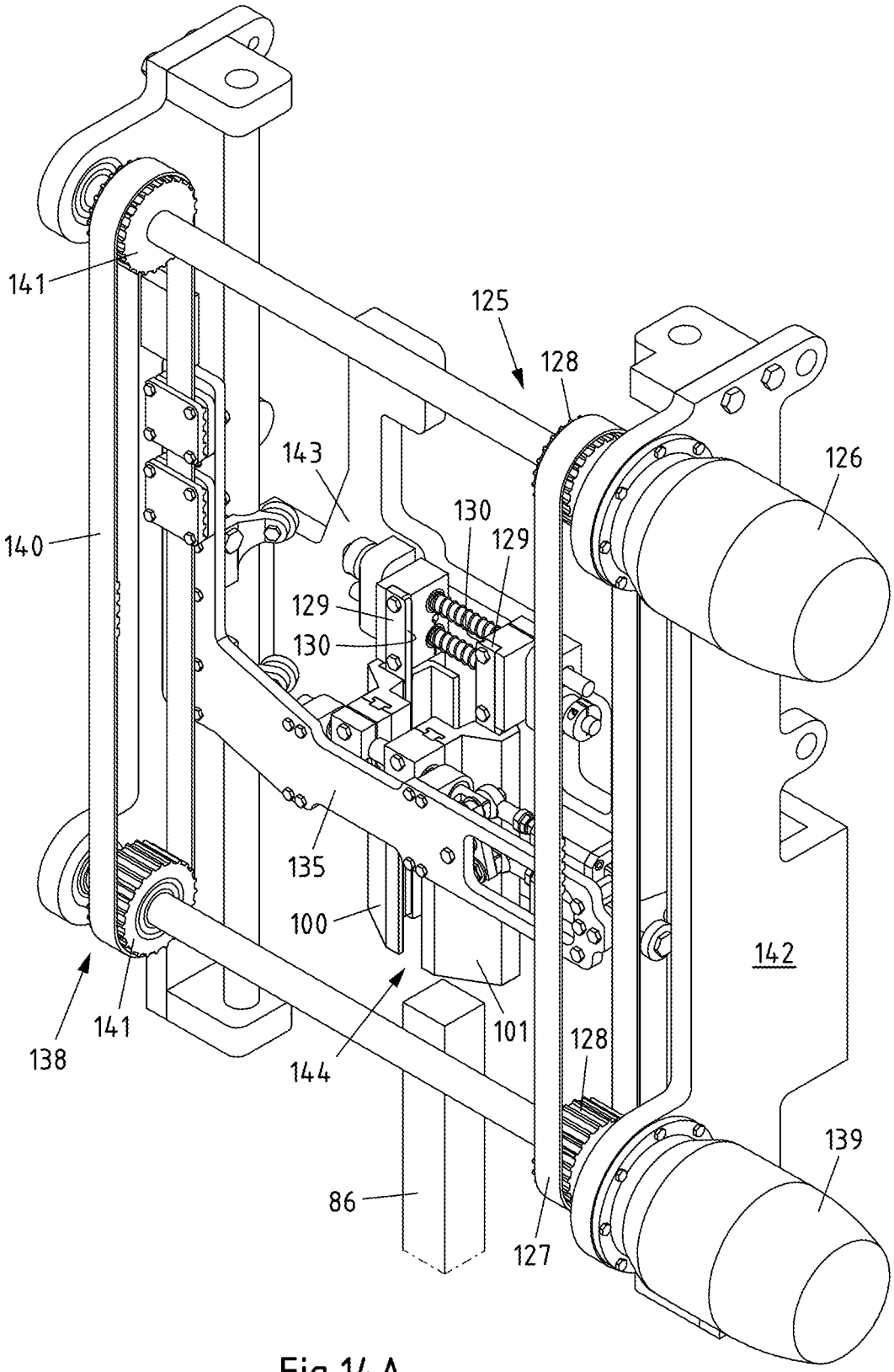
FIGS. 14A-B show the unfolding device of the moulding station from FIG. 10 in an open and a closed position in a perspective view.
Figure 14B:
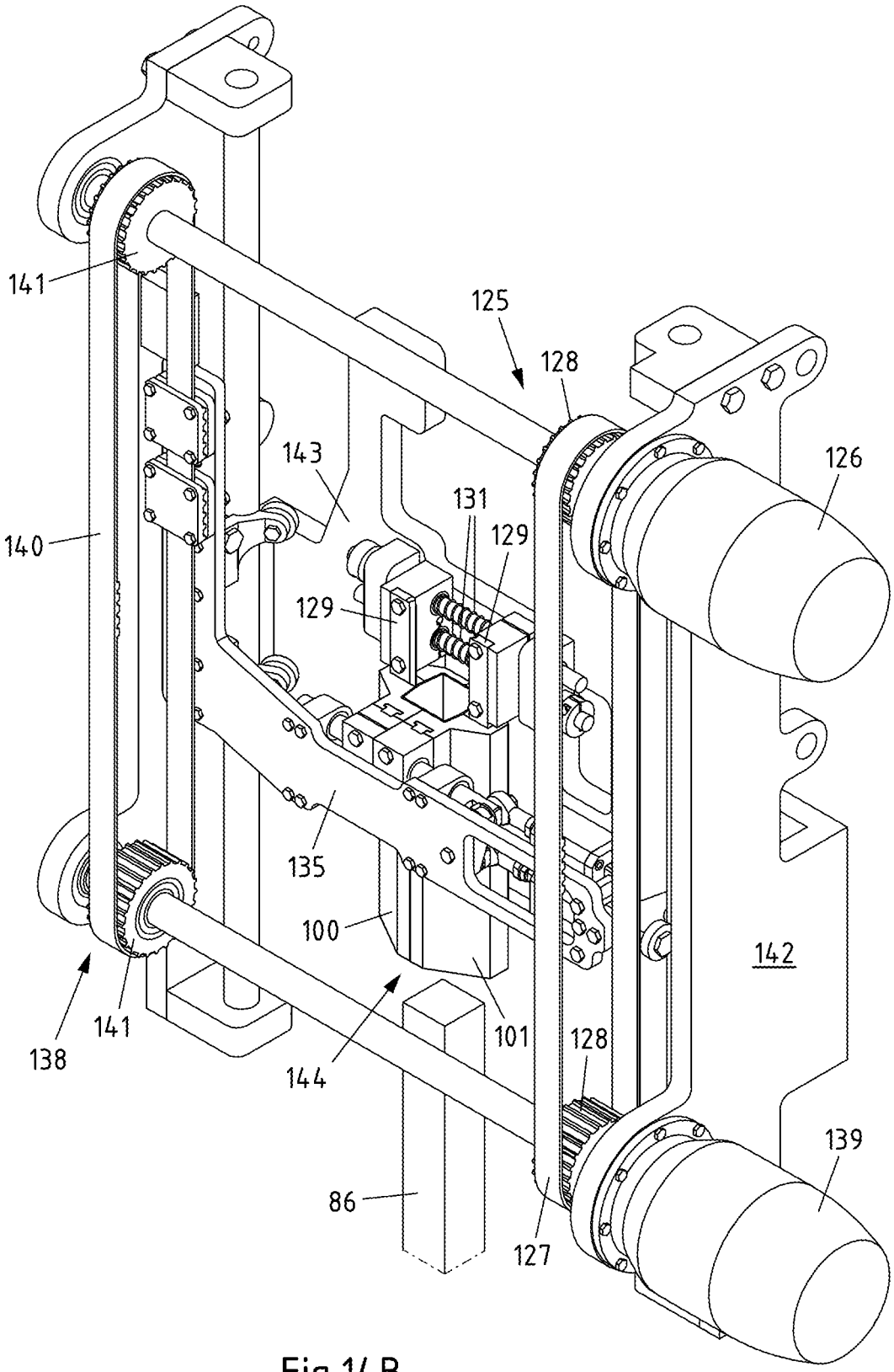

When leaving the channel 97 downwards, the package sleeve 63 is received by the groove elements 129 shown in particular in FIGS. 14A-B, which groove elements at least directly adjoin the channel 95 at the moulding station 84 shown and in this respect preferred, even if the groove elements 129 are separate elements. The groove elements 129 provide grooves 130, which are aligned with the grooves 97 of the channel 95. Thus, after leaving the channel 95, the package sleeve 63 is guided with its folding edges 65 further in the grooves 130 of the groove elements 129. The groove elements 129 also extend downwards into the two mould halves 100, 101 of the unfolding device 83 in the case of the device shown and in this respect preferred. The mould halves 100, 101 are first arranged with the groove elements 129 in an open position, in which a package sleeve 63 is pushed along the grooves 97, 130 by means of the feeding device 98 from the channel 95 downwards between the mould halves 100, 101. Once the package sleeve 63 has arrived there, the mould halves 100, 101 are closed with the groove elements 129 with the mould halves 100, 101 moving towards each other. In doing so, the grooves 130 of the groove elements 129 press against the folding edges 65 of the package sleeve 63, which is thus unfolded and in doing so contacts, from the inside, the inner contour of the mould 99 formed by the mould halves 100, 101.

Figure 15:
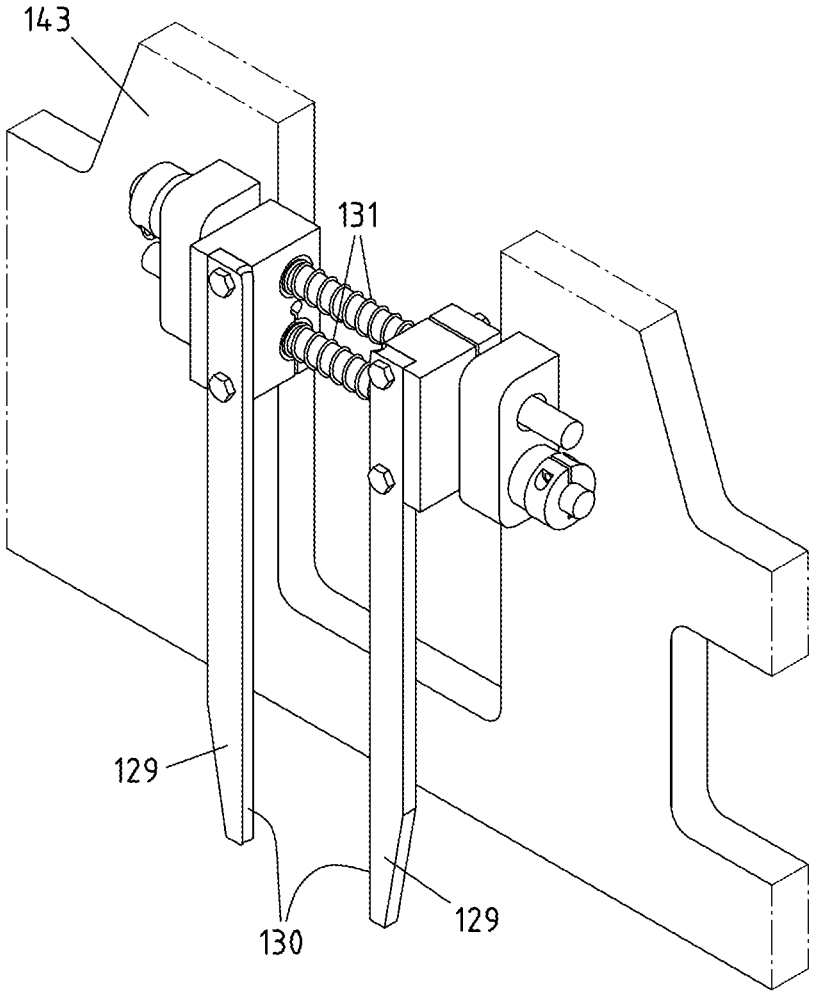
FIG. 15 shows a detail of the unfolding device from FIG. 13 in a perspective view.

The groove elements 129 are pressed together against the restoring force of two spring elements 131 provided between the groove elements 129, as shown in FIG. 15 in particular. In this way it is ensured that the groove elements 129 are moved apart again into their initial position when the mould 99 is opened or when the mould halves are moved apart.

Figure 16A:
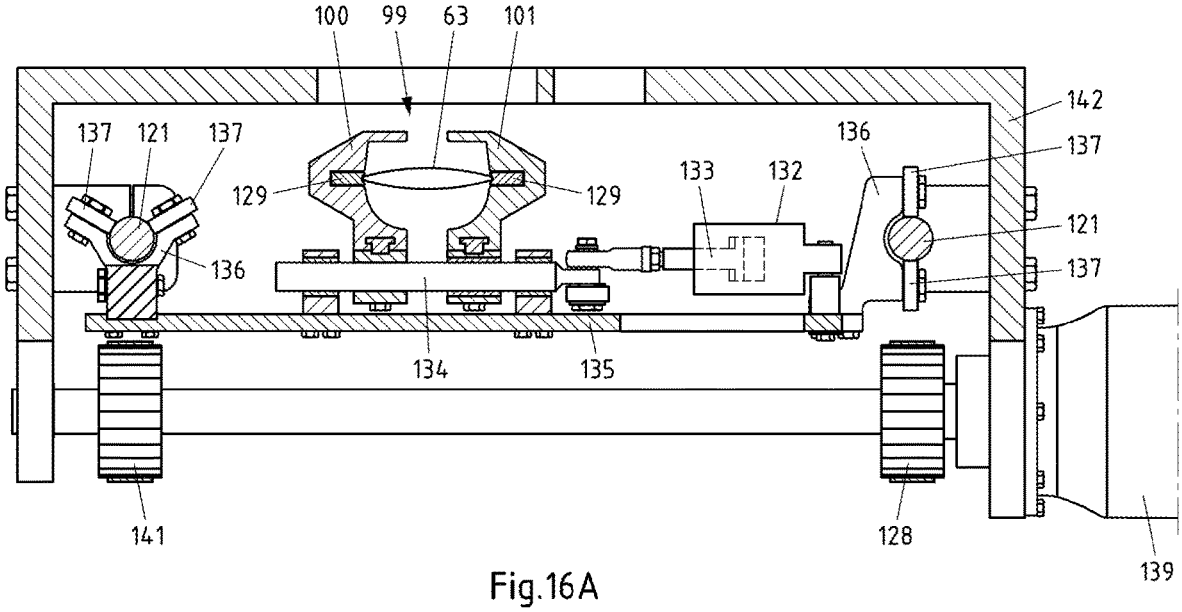
FIGS. 16A-C show the unfolding device of the moulding station from FIG. 10 in an open and a closed position along horizontal section planes from above and FIG. 17 shows the transfer device of the moulding station from FIG. 10 for transferring the package sleeves to the mandrels of the mandrel wheel in a perspective view.
Figure 16B:
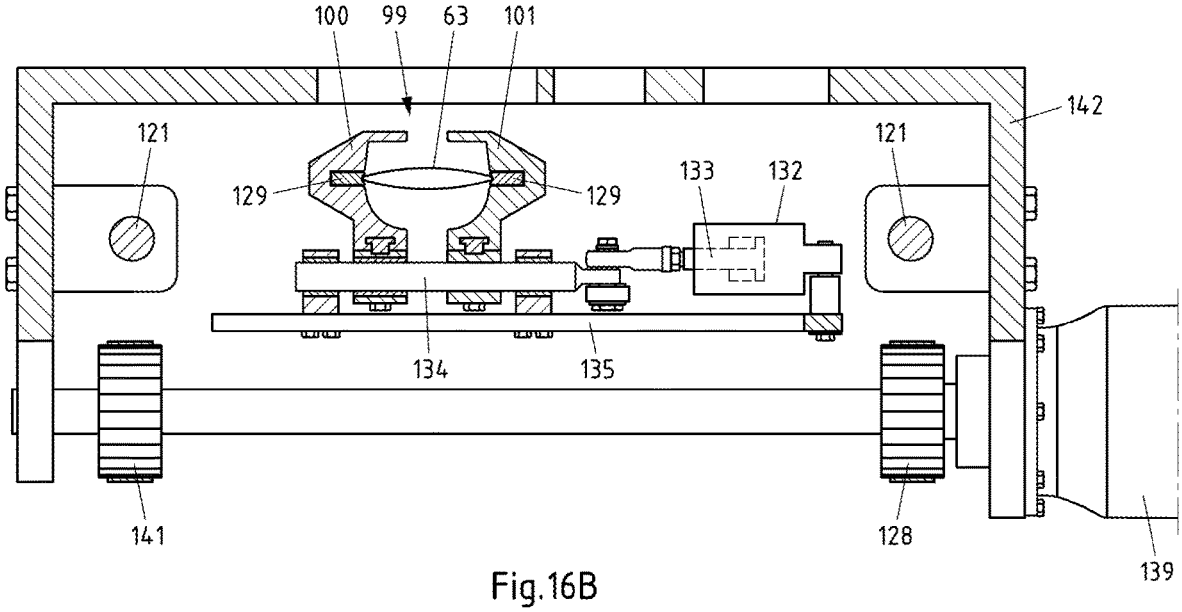
Figure 16C:
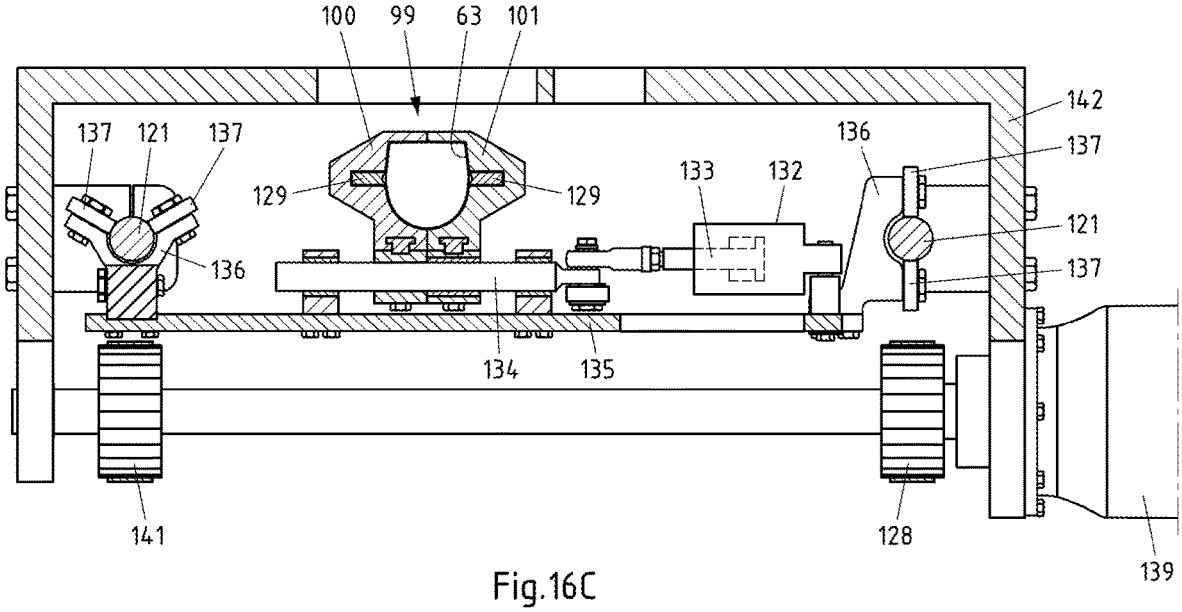

In FIGS. 16A-C the unfolding device is shown in horizontal sections from above. In FIGS. 16A-B the mould halves 100, 101 are or the mould 99 is in the open position. Two positioning cylinders 132 are provided one above the other, each of which has a plunger 133, which is displaceable in the positioning cylinder 132 and is connected to a mould half 100, 101 via a rod 134. The positioning cylinders 132 are designed in such a way that they can pneumatically or hydraulically move the associated mould half 100, 101 into the closed position. As a result, the mould halves 100, 101 enter the closed position shown in FIG. 16C with the unfolded package sleeve 63 between them, which contacts the inner contour of the mould 99 formed by the mould halves 100, 101. The mould halves 100, 101 are held together with the positioning cylinders 132 on a traverse 135, which can be moved vertically up and down via carriages 136 on the lateral guides 121. In this way, the mould 99 or the mould halves 100, 101 can be moved downwards in the closed position and upwards in the open position. For this purpose, the carriages 136 run up and down via rollers 137 on the rod-shaped guides 121. The traverse 135 is driven by a belt drive 138, which is driven by a motor drive 139. The belt 140 is laid circumferentially as a closed belt 140 around two deflection rollers 141, of which one deflection roller 141 can be driven in opposite directions by the motor drive 139 as required. The corresponding unit can be considered a transfer device 144.

The lateral guides 121, the belt drives 125, 138 and the motor drives 126, 139 are held and mounted on a common frame 142. Furthermore, a traverse 143 holding the groove elements 129 is fixed in place in the common frame 142. The groove elements 129 can therefore be moved together and apart again but not up and down. The groove elements 129 therefore retain their position when the mould 99 is moved downwards.

Figure 17:
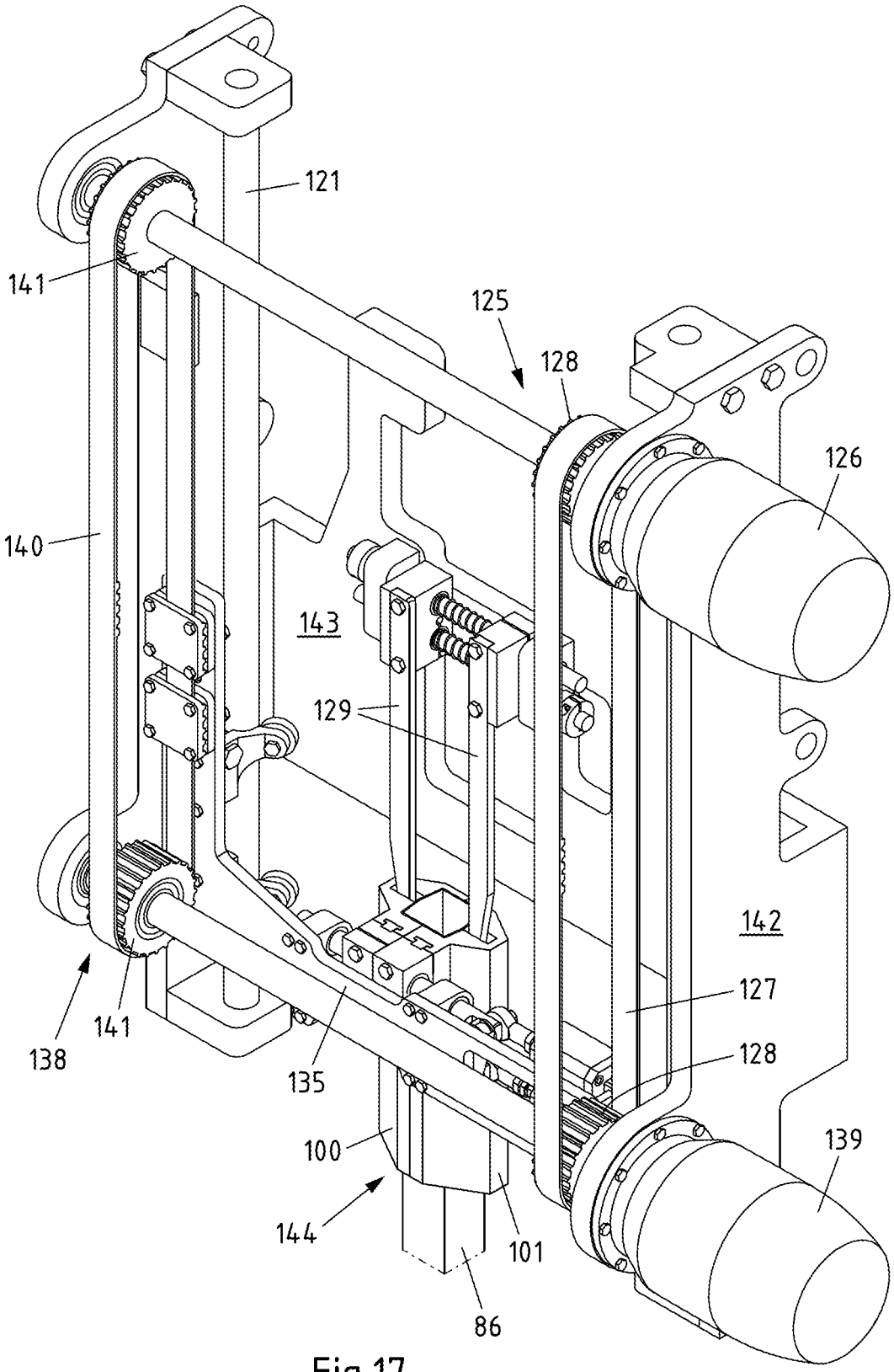

As shown in FIG. 17 in particular, when the mould 99 is moved down, the package sleeve 63 unfolded therein is pushed onto the mandrel 86 of the mandrel wheel 85 arranged underneath. The mould 99 can then be opened by the restoring force of the spring means 131 arranged between the groove elements 129 instead of being opened by the positioning cylinders 132. However, this is not necessary. After opening or during opening, the mould halves 100, 101 are moved upwards via the traverse 135 in order to receive a further package sleeve 63 to unfold. Since the groove elements 129 are not vertically adjusted, the groove elements 129 can already receive a new package sleeve 63 if required after the mould 99 has been opened, while the mould 99 is moved back into its top position in order to receive and unfold the package sleeve 63 in this position.

The invention claimed is:

1. A method for at least partially unfolding flat-folded package sleeves, providing the flat-folded package sleeves, holding the package sleeves, which are folded flat in a stack around at least two folding edges extending in the longitudinal direction of the package sleeves, ready for further processing, gripping the flat-folded package sleeves successively on a side facing away from the stack by a gripper and moving, in particular pulling, the flat-folded package sleeves by the gripper along a withdrawal transport path of the package sleeves with the folding edges positioned in grooves of at least one receptacle of a moulding station, thereby at least partially unfolding the package sleeves, moving, in particular pressing, the package sleeves received with the folding edges in the grooves of the at least one receptacle at least in sections by the gripper against the withdrawal transport path, and moving, in particular pulling, the package sleeves moved back at least in sections against the withdrawal transport path and received with the folding edges in the grooves again at least in sections by the gripper in the direction of the withdrawal transport path.

2. The method according to claim 1, further comprising:

receiving, at least partially, the package sleeves are at least partially received in a transport direction defined by the withdrawal transport path in a bent and/or kinked manner in the grooves, bending and/or kinking the package sleeves, when being partially moved back against the withdrawal transport path in the grooves, at least in sections against the transport direction defined by the withdrawal transport path, and again bending back and/or kinking the package sleeves, when being moved back in the transport direction defined by the withdrawal transport path in the grooves, at least in sections in the transport direction defined by the withdrawal transport path.

3. The method according to claim 1, further comprising:

gripping the sides of the package sleeves facing away from the stack by suction cups of the gripper and pulling the package sleeves from the stack, and/or moving, in particular pulling, the package sleeves from the stack along a straight withdrawal transport path parallel to the stacking direction of the packages in the stack, and into the grooves.

4. The method according to claim 1, further comprising: unfolding the package sleeves in the moulding station.

5. The method according to claim 4, further comprising: positioning the package sleeves in the moulding station between at least two mould halves of a mould and unfolding the package sleeves by at least partially closing the mould, and unfolding the package sleeve by at least substantially circumferentially coming into contact of the package sleeve to the inside of the mould.

6. The method according to claim 4, further comprising: pressing, in the moulding station, the package sleeves, via the grooves of the at least one receptacle, from opposite sides of the package sleeve against the at least two folding edges such that the at least two folding edges of the package sleeve move towards one another, thereby unfolding the package sleeve.

7. The method according to claim 1, further comprising: pulling the package sleeves, before being received in the grooves, through a channel which comes into contact with the two opposite folding edges of the package sleeve and tapers transversely to the package sleeve and transversely to the transport direction of the package sleeves, thereby forcing the package sleeves to unfold.

8. The method according to claim 1, further comprising: pushing the unfolded package sleeves by the moulding station onto a mandrel in order to close, in particular seal, a longitudinal end of the package sleeve.

9. The method according to claim 1, further comprising: further transporting the package sleeves in the longitudinal direction of the grooves, in particular in the grooves and/or with the grooves, in particular into a mould and/or onto a mandrel.

10. The method according to claim 1, further comprising: moving, in particular pressing, the package sleeves with the grooves further in the direction of the withdrawal transport path relative to the gripper, and moving back, in particular pulling, the package sleeves moved further in the direction of the withdrawal transport path relative to the gripper and received with the folding edges in the grooves with the grooves against the direction of the withdrawal transport path relative to the gripper.

11. A device for at least partially unfolding package sleeves, comprising: a magazine comprising a stack formed from package sleeves, wherein the package sleeves of the stack are folded flat around at least two folding edges extending in the longitudinal direction of the package sleeves and wherein a gripper is provided for gripping a side of the package sleeves facing away from the stack and for moving, in particular pulling, the package sleeves along a withdrawal transport path with the folding edges into grooves of at least one receptacle of a moulding station and wherein the grooves are spaced so that the folding edges of the package sleeves are spaced apart further in the magazine than in the grooves, characterised in that a drive is assigned to the gripper for moving the package sleeve section gripped by the gripper first along the withdrawal transport path across a groove plane which connects the grooves, then back over the groove plane against the withdrawal transport path, and then again along the withdrawal transport path across the groove plane.

12. The device according to claim 11, characterised in that the gripper has suction cups for gripping the package sleeves held in the magazine and/or in that the drive is designed to move the gripper between the magazine and the grooves along a straight withdrawal transport path, parallel to the stacking direction of the packages in the stack.

13. The device according to claim 11, characterised in that the moulding station has at least two mould halves for simultaneously pressing together and unfolding the package sleeves, and in that, the mould halves are designed for at least substantially circumferential contact of the package sleeves with the inside of the mould.

14. The device according to claim 11, characterised in that the grooves of the at least one receptacle are provided so as to be adjustable from a receiving position for receiving the package sleeves at a large distance from one another into an unfolding position for unfolding the package sleeves at a smaller distance from one another and back.

15. The device according to claim 11, characterised in that the moulding station, viewed in the withdrawal transport direction, has, in front of the grooves, a tapered channel for at least partially, forcibly unfolding the package sleeves which are moved through the channel, and in that the width of the channel tapers in the withdrawal transport direction of the package sleeves to a dimension which is smaller than the width of the flat-folded package sleeves received in the magazine.

16. The device according to claim 15, characterised in that the grooves for receiving the folding edges are assigned to the end of the channel, in particular arranged at the end of the channel.

17. The device according to claim 11, characterised in that a mandrel is provided for pushing the unfolded package sleeves and for closing, in particular for sealing, a longitudinal end of the package sleeve on the mandrel and/or in that displacement means are provided for displacing the package sleeves received in the grooves in the longitudinal direction of the grooves, in particular in the grooves and/or with the grooves, in particular into a mould and/or onto a mandrel.

18. The device according to claim 11, wherein the drive is also assigned to the grooves for moving the package sleeve section in the grooves along the withdrawal transport path across and back against the withdrawal transport path.

* * * * *